US012560158B2

(12) United States Patent
Anderson et al.

(10) Patent No.: US 12,560,158 B2
(45) Date of Patent: Feb. 24, 2026

(54) DIAPHRAGM PUMP

(71) Applicant: Blue-White Industries, Ltd., Huntington Beach, CA (US)

(72) Inventors: Nicholas James Anderson, North Hollywood, CA (US); Robert E. Gledhill, III, Huntington Beach, CA (US); Ricky Chandy Lee, Long Beach, CA (US); John T. Nguyen, Fountain Valley, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 121 days.

(21) Appl. No.: 18/664,059

(22) Filed: May 14, 2024

(65) Prior Publication Data

US 2024/0392770 A1 Nov. 28, 2024

Related U.S. Application Data

(60) Provisional application No. 63/504,399, filed on May 25, 2023.

(51) Int. Cl.
*F04B 43/02* (2006.01)
*F04B 53/10* (2006.01)

(52) U.S. Cl.
CPC ..... *F04B 43/026* (2013.01); *F04B 53/1005* (2013.01)

(58) Field of Classification Search
CPC .. F04B 43/026; F04B 53/1005; F04B 43/025; F04B 43/02
See application file for complete search history.

(56) References Cited

U.S. PATENT DOCUMENTS

| | | | | |
|---|---|---|---|---|
| 3,661,167 | A * | 5/1972 | Hussey | F16K 15/042 137/533.15 |
| 4,936,753 | A | 6/1990 | Kozumplik, Jr. et al. | |
| 7,001,153 | B2 | 2/2006 | McDowell et al. | |
| 7,284,964 | B2 | 10/2007 | McDowell et al. | |
| 8,215,931 | B2 | 7/2012 | McDowell et al. | |
| 8,418,364 | B2 | 4/2013 | McDowell et al. | |
| 8,639,363 | B2 | 1/2014 | Gledhill, III et al. | |
| 9,374,024 | B2 | 6/2016 | Nguyen et al. | |

(Continued)

FOREIGN PATENT DOCUMENTS

GB 2565911 A * 2/2019

*Primary Examiner* — Bryan M Lettman
(74) *Attorney, Agent, or Firm* — Knobbe, Martens, Olson & Bear, LLP

(57) ABSTRACT

A diaphragm pump can include an inlet, an outlet, and a pump chamber positioned in a fluid path between the inlet and outlet. The assembly can include a diaphragm and a movable piston. Movement of the piston toward the pump chamber can force a portion of the diaphragm to move from its rest position to a position further within the pump chamber and to increase pressure in the pump chamber. Movement of the piston away from the pump chamber can force a portion of the diaphragm to move from its rest position to a position away from the pump chamber and to reduce pressure in the pump chamber. The assembly can also include a first and second check valve. In the closed position, the second check valve can be unsealed to provide an escape path for gas. In the closed position, the first check valve can be sealed.

35 Claims, 14 Drawing Sheets

(56) References Cited

U.S. PATENT DOCUMENTS

| | | | |
|---|---|---|---|
| 9,389,109 | B2 | 7/2016 | Gledhill, III et al. |
| 9,777,720 | B2 | 10/2017 | Gledhill, III et al. |
| 9,828,984 | B2 | 11/2017 | Gledhill, III et al. |
| 9,909,579 | B2 | 3/2018 | Gledhill, III et al. |
| 9,996,089 | B2 | 6/2018 | Gledhill, III et al. |
| 10,330,094 | B2 | 6/2019 | Gledhill, III et al. |
| 10,948,320 | B2 | 3/2021 | Gledhill, III et al. |
| 11,131,300 | B2 | 9/2021 | Gledhill, III et al. |
| 11,150,118 | B2 | 10/2021 | Gledhill, III et al. |
| 11,221,004 | B2 | 1/2022 | Gledhill, III et al. |
| 11,261,857 | B2 | 3/2022 | Gledhill, III et al. |
| D959,238 | S | 8/2022 | Nguyen et al. |
| 11,402,248 | B2 | 8/2022 | Gledhill, III et al. |
| 11,485,653 | B2 | 11/2022 | Gledhill, III et al. |
| 11,578,716 | B2 | 2/2023 | Gledhill, III et al. |
| 11,639,863 | B2 | 5/2023 | Nguyen et al. |
| 11,703,362 | B2 | 7/2023 | Nguyen et al. |
| 11,754,065 | B2 | 9/2023 | Nguyen et al. |
| 11,768,092 | B2 | 9/2023 | Gledhill, III et al. |
| 11,768,929 | B2 | 9/2023 | Gledhill, III et al. |
| 11,781,709 | B2 | 10/2023 | Nguyen et al. |
| 11,891,989 | B2 | 2/2024 | Gledhill, III et al. |
| 11,898,546 | B2 | 2/2024 | Gledhill, III et al. |
| 11,939,972 | B2 | 3/2024 | Nguyen et al. |
| D1,030,452 | S | 6/2024 | Nguyen et al. |
| 12,044,354 | B2 | 7/2024 | Nguyen et al. |
| 12,049,887 | B2 | 7/2024 | Nguyen et al. |
| 2010/0005655 | A1 | 1/2010 | Nguyen |
| 2011/0180172 | A1 | 7/2011 | Gledhill, III et al. |
| 2014/0119952 | A1* | 5/2014 | Adachi ..... F04B 13/02 417/474 |
| 2015/0110654 | A1* | 4/2015 | Bubb ..... F04B 43/06 417/435 |
| 2015/0211509 | A1 | 7/2015 | Gledhill, III et al. |
| 2017/0051734 | A1 | 2/2017 | Gehrke et al. |
| 2017/0342977 | A1 | 11/2017 | Simmons et al. |
| 2018/0291886 | A1 | 10/2018 | Gledhill, III et al. |
| 2018/0298891 | A1 | 10/2018 | Gledhill, III et al. |
| 2019/0390778 | A1* | 12/2019 | Ogawa ..... F16K 1/14 |
| 2022/0235754 | A1 | 7/2022 | Hines et al. |
| 2022/0316463 | A1 | 10/2022 | Gledhill, III et al. |
| 2023/0287881 | A1 | 9/2023 | Murphy et al. |
| 2023/0417582 | A1 | 12/2023 | Nguyen et al. |
| 2024/0003724 | A1 | 1/2024 | Nguyen et al. |
| 2024/0011479 | A1 | 1/2024 | Gledhill, III et al. |
| 2024/0028694 | A1 | 1/2024 | Gledhill, III et al. |
| 2024/0110559 | A1 | 4/2024 | Nguyen et al. |
| 2024/0247959 | A1 | 7/2024 | Gledhill, III et al. |
| 2024/0254983 | A1 | 8/2024 | Nguyen et al. |
| 2024/0271612 | A1 | 8/2024 | Murphy et al. |

* cited by examiner

DIAPHRAGM PUMP

CROSS-REFERENCE TO RELATED APPLICATIONS

This application claims priority to U.S. Provisional Application No. 63/504,399, filed May 25, 2023, and entitled "DIAPHRAGM PUMP." This application is related to U.S. patent application Ser. No. 15/963,770, filed Apr. 26, 2018, titled MULTIPLE DIAPHRAGM PUMP, which claims the benefit of U.S. Provisional Application No. 62/531,733, filed Jul. 12, 2017, titled MULTIPLE DIAPHRAGM PUMP, and of U.S. Provisional Application No. 62/535,159, filed Jul. 20, 2017, titled MULTIPLE DIAPHRAGM PUMP. The entire contents of each of the above-identified patent applications are incorporated by reference herein and made a part of this specification for all that they disclose.

TECHNICAL FIELD

The present inventions relate to diaphragm pumps, and more specifically to a diaphragm pump with gas release.

DESCRIPTION OF THE RELATED ART

Diaphragm pumps are a type of positive displacement pump used to pump accurate amounts of chemical into water treatment plants. Diaphragm pumps can handle much higher system pressures than other positive displacement pump technologies, such as peristaltic pumps. Diaphragm pumps are common in the water treatment industry with one or more diaphragms. Multi-diaphragm pump designs are typically marketed in industry with separate inlets and outlets for each diaphragm. One benefit of multi-diaphragm pump designs is the capability to pump multiple chemicals with a single drive and controller.

Diaphragm pumps can lose its prime overnight or when pumping at a low speed due to trapped gas in the pump head and its valves. This is a common problem known as vapor lock with diaphragm pumps when dosing off-gassing chemicals such as sodium hypochlorite. Sodium hypochlorite (NaOCl) is one of the most versatile bleaching, cleaning, deodorizing, and disinfecting compounds available in the industrial markets. This adaptability makes it a common fluid in the manufacturing industry. However, NaOCl also off-gasses. Furthermore, the pump typically can only be primed against a low pressure, e.g. close to atmospheric pressure.

Other pumps such as peristaltic pumps, can be used instead of diaphragm pumps if they are successful when pumping chemicals containing bubbles or trapped gas without vapor lock. However, such pumps typically can only handle line pressures of 120 psi or less. Pump tubes can burst quickly above this pressure range when system pressures exceed 120 psi. For pumping applications with high pressure such as above 100 psi, above 120 psi, or above 125 psi, there is a need for improved diaphragm pumps.

SUMMARY

Certain embodiments have particularly advantageous applicability in connection with diaphragm pumps that are configured to release gas.

In various implementations, a diaphragm pump assembly can include an assembly inlet, and assembly outlet, a first pump chamber positioned in a first fluid path between the assembly inlet and outlet, and a second pump chamber positioned in a second fluid path between the assembly inlet and outlet. The assembly can also include a first diaphragm and a second diaphragm. The first diaphragm can be positioned at least partially within the first pump chamber at a rest position. The first diaphragm can have a perimeter sealingly connected to one or more walls of the first pump chamber. The second diaphragm can be positioned at least partially within the second pump chamber at a rest position. The second diaphragm can have a perimeter sealingly connected to one or more walls of the second pump chamber.

In various implementations, a first piston can be connected to the first diaphragm. The first piston can be movable linearly. A second piston can be connected to the second diaphragm. The second piston can be movable linearly. Movement of the first piston toward the first pump chamber can force a portion of the first diaphragm to move from its rest position to a position further within the first pump chamber and to increase pressure in the first pump chamber. Movement of the first piston toward the first pump chamber can force a portion of the second diaphragm to move from its rest position to a position away from the second pump chamber and to reduce pressure in the second pump chamber. Movement of the second piston toward the second pump chamber can force a portion of the first diaphragm to move from its rest position to a position away from the first pump chamber and to reduce pressure in the first pump chamber. Movement of the second piston toward the second pump chamber can force a portion of the second diaphragm to move from its rest position to a position further within the second pump chamber and to increase pressure in the second pump chamber.

In various implementations, a first check valve can be positioned in a fluid path between the assembly inlet and the first pump chamber. The first check valve can be configured when in an opened position to permit fluid flow from the assembly inlet into the first pump chamber and when in a closed position to inhibit fluid flow from the first pump chamber toward the assembly inlet. A second check valve can be positioned in a fluid path between the first pump chamber and the assembly outlet. The second check valve can be configured when in an opened position to permit fluid flow from the first pump chamber toward the assembly outlet and when in a closed position to reduce fluid flow from the assembly outlet into the first pump chamber. A third check valve can be positioned in a fluid path between the assembly inlet and the second pump chamber. The third check valve can be configured when in an opened position to permit fluid flow from the assembly inlet into the second pump chamber and when in a closed position to inhibit fluid flow from the second pump chamber toward the assembly inlet. A fourth check valve can be positioned in a fluid path between the second pump chamber and the assembly outlet. The fourth check valve can be configured when in an opened position to permit fluid flow from the second pump chamber toward the assembly outlet and when in a closed position to reduce fluid flow from the assembly outlet into the second pump chamber.

In various implementations, each check valve can comprise at least one pair of a spherical ball and a seat opening. For each pair, the spherical ball can contact the seat opening when in the closed position. In the closed position, the second check valve can have for each pair, a gap between its spherical ball and seat opening to provide an escape path for gas. In the closed position, the first and third check valves can have for each pair, no gap between its spherical ball and seat opening.

In some implementations, the rest position of the first diaphragm can be further within the first pump chamber and/or the rest position of the second diaphragm can be further within the second pump chamber to provide a fluid flow rate as if the second check valve has for each pair, no gap between its spherical ball and seat opening when in the closed position and/or the fourth check valve has for each pair, no gap between its spherical ball and seat opening when in the closed position.

In some instances, for each pair, the gap of the second check valve can be at least 2800 $\mu m^2$.

In some instances, for each pair, the gap of the second check valve can be no larger than 45,500 $\mu m^2$.

In some instances, for each pair, the gap of the second check valve can be in the range from 2800 $\mu m^2$ to 45,500 $\mu m^2$.

In various implementations, for each check valve, for each pair, the spherical ball has a radius and the seat opening has a radius. The radius of the spherical ball can be greater than the radius of the seat opening. For example, the radius of the spherical ball can be greater than the radius of the seat opening by at least 25%. As another example, the radius of the spherical ball can be greater than the radius of the seat opening by no more than 45%. As another example, the radius of the spherical ball can be greater than the radius of the seat opening by an amount within the range from 25% to 45%.

In some examples, in the closed position, the fourth check valve can have for each pair, no gap between its spherical ball and seat opening.

In some examples, in the closed position, the fourth check valve can have for each pair, a gap between its spherical ball and seat opening to provide an escape path for gas.

In some designs, for each pair, the gap of the fourth check valve can be at least 2800 $\mu m^2$.

In some designs, for each pair, the gap of the fourth check valve can be no larger than 45,500 $\mu m^2$.

In some designs, for each pair, the gap of the fourth check valve can be in the range from 2800 $\mu m^2$ to 45,500 $\mu m^2$.

In some examples, for each pair in the fourth check valve, the seat opening can be provided by at least one O-ring.

In some instances, the at least one pair can comprise one pair.

In some instances, the at least one pair can comprise two pairs.

In some designs, the assembly can be capable of being primed at a pressure greater than 100 psi. For example, the assembly can be capable of being primed at a pressure within a range greater than 100 psi to 165 psi. As another example, the assembly can be capable of being primed at a pressure within a range greater than 120 psi to 165 psi.

In certain implementations, the assembly can be configured to pump a chemical that off-gasses and the second check valve can provide the escape path for the off-gas. The chemical can be sodium hypochlorite.

Some implementations can further comprise a motor, a motor drive shaft connected to the motor, and an offset cam connected to the motor drive shaft and configured to rotate in unison with the motor drive shaft. The offset cam can be configured to push the first piston in a first direction toward the first pump chamber during a first portion of one rotation of the motor drive shaft and to push the second piston in a second direction toward the second pump chamber during a second portion of one rotation of the motor drive shaft. The first direction and the second direction can be collinear.

In various implementations, a diaphragm pump assembly can include an assembly inlet, an assembly outlet, and a pump chamber positioned in a fluid path between the assembly inlet and outlet. The diaphragm can be positioned at least partially within the pump chamber at a rest position. The diaphragm can be sealingly connected to one or more walls of the pump chamber. A movable piston can be connected to the diaphragm.

In various implementations, movement of the piston toward the pump chamber can force a portion of the diaphragm to move from its rest position to a position further within the pump chamber and to increase pressure in the pump chamber. Movement of the piston away from the pump chamber can force a portion of the diaphragm to move from its rest position to a position away from the pump chamber and to reduce pressure in the pump chamber.

In various implementations, a first check valve can be positioned in a fluid path between the assembly inlet and the pump chamber. The first check valve can be configured when in an opened position to permit fluid flow from the assembly inlet into the pump chamber and when in a closed position to inhibit fluid flow from the pump chamber toward the assembly inlet.

In various implementations, a second check valve can be positioned in a fluid path between the pump chamber and the assembly outlet. The second check valve can be configured when in an opened position to permit fluid flow from the pump chamber toward the assembly outlet and when in a closed position to reduce fluid flow from the assembly outlet into the pump chamber.

In some designs, in the closed position, the second check valve can be unsealed to provide an escape path for gas. In the closed position, the first check valve can be sealed.

In some designs, the maximum distance the diaphragm extends into the pump chamber can provide a fluid flow rate within twenty percent of a fluid flow rate which there would be through the second check valve if the second check valve were sealed when in the closed position.

In some examples, in the closed position, the first check valve can be sealed with at least one O-ring.

In some examples, in the closed position, the first check valve can be sealed with two O-rings.

In some implementations, each check valve can comprise a spherical ball and a seat opening. The spherical ball can contact the seat opening when in the closed position. In the closed position, the first check valve can have no gap between its spherical ball and seat opening. In the closed position, the second check valve can have a gap between its spherical ball and seat opening.

In some implementations, each check valve can comprise a second spherical ball and a second seat opening. The second spherical ball can contact the second seat opening when in the closed position. In the closed position, the first check valve can have no gap between its second spherical ball and second seat opening. In the closed position, the second check valve can have a gap between its second spherical ball and second seat opening.

In various designs, the assembly can be capable of being primed at a pressure of greater than 100 psi. For example, the assembly can be capable of being primed at a pressure within a range of greater than 120 psi to 165 psi.

In some examples, the assembly can be configured to pump a chemical that off-gasses and the second check valve can provide the escape path for the off-gas. The chemical can be sodium hypochlorite.

In some examples, the assembly can further comprise a motor, a motor drive shaft connected to the motor, and a cam connected to the motor drive shaft and configured to rotate in unison with the motor drive shaft. The cam can be configured to push the piston in a first direction toward the pump chamber during a first portion of one rotation of the motor drive shaft and to push the piston in a second direction away from the pump chamber during a second portion of one rotation of the motor drive shaft. The first direction and the second direction can be collinear.

In some assemblies, the second check valve can permit at least 30% of the pressure between the first pump chamber and the assembly outlet to be released in 8 hours.

In some assemblies, the second check valve can permit the pressure between a first spherical ball and a second spherical ball and the assembly outlet to equalize within 10 hours when the system has an internal pressure of 120 psi and the outlet has a pressure of 50 psi.

BRIEF DESCRIPTION OF THE DRAWINGS

Various features of illustrative embodiments of the inventions are described below with reference to the drawings. The illustrated embodiments are intended to illustrate, but not to limit, the inventions. The drawings contain the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

As noted above, embodiments of the present inventions can overcome several prior art deficiencies and provide advantageous results. Some embodiments provide for a multiple diaphragm pump that can operate at high pressures while maintaining a high flow rate. Some embodiments allow the multiple diaphragm pump to operate effectively at higher pressures and flow rates without requiring that the pump have a larger motor. Some embodiments of diaphragms that may be used with multiple diaphragm pumps according to the present inventions are discussed in U.S. Patent Application No. 61/919,556, entitled "A SEALING DIAPHRAGM AND METHODS OF MANUFACTURING SAID DIAPHRAGM," filed Dec. 20, 2013, which is hereby incorporated by reference in its entirety.

Figure 1:
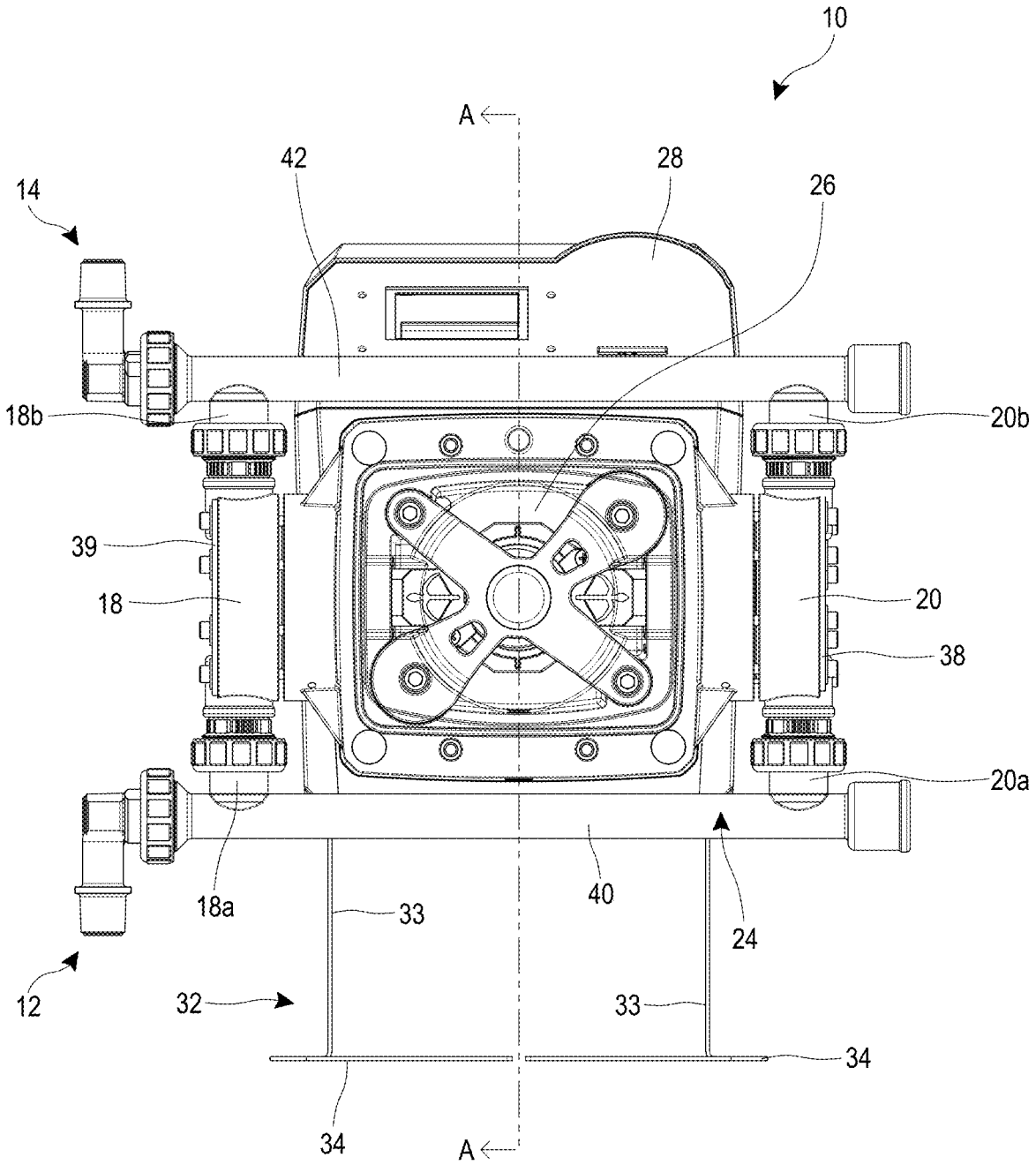
FIG. 1 is a front view of a pump assembly according to the present disclosure.
Figure 2:
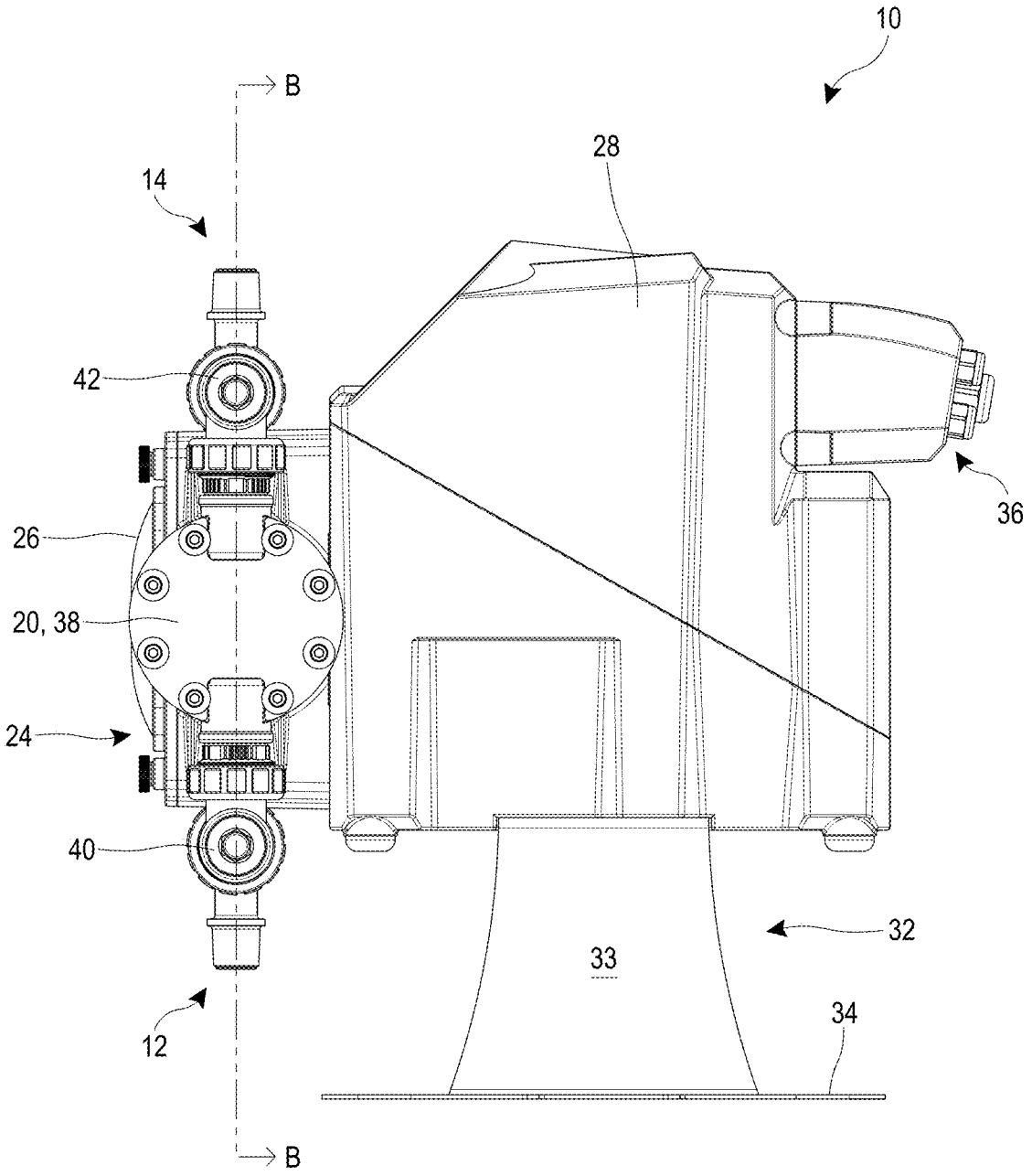
FIG. 2 is a right side view of the pump assembly of FIG. 1.

FIGS. 1 and 2 illustrate an embodiment of a diaphragm pump assembly 10. The assembly 10 can include an inlet 12 and an outlet 14. While the pump assembly 10 is illustrated as having a single inlet 12 and a single outlet 14, in some embodiments, the pump assembly 10 has additional inlets and/or outlets. In some embodiments, the pump assembly 10 has more inlets than outlets. In some embodiments, the pump assembly has more outlets than inlets. In some embodiments, the pump assembly has the same number of inlets and outlets.

The pump assembly 10 can include at least one pump chamber. As illustrated, the pump assembly 10 can include a first pump chamber 18 and a second pump chamber 20. The first and second pump chambers 18, 20 can be positioned in parallel to each other in fluid flow paths between the inlet 12 and the outlet 14. The pump assembly 10 can include an inlet connector passage 40 extending between an inlet 18*a* of the first pump chamber 18 and an inlet 20*a* of the second pump chamber 20. The inlet connector passage 40 can be configured to fluidly connect the first and second pump chambers 18, 20 to the inlet 12 of the pump assembly 10. The pump assembly 10 can include an outlet connector passage 42 extending between an outlet 18*b* of first pump chamber 18 and an outlet 20*b* of the second pump chamber 20. The outlet connector passage 42 can be configured to fluidly connect the first and second pump chambers 18, 20 to the outlet 14. In some embodiments, a first end cap 39 can be used to connect the first pump chamber 18 to the pump assembly 10. In some embodiments, a second end cap 38 can be used to connect the second pump chamber 20 to the pump assembly 10. In some embodiments, the first end cap 39 forms a boundary of the first pump chamber 18. In some embodiments, the second end cap 38 (as best seen in FIG. 2) forms a boundary of the second pump chamber 20.

The pump assembly 10 can include a drive assembly 24. The drive assembly 24 can be positioned between the first and second pump chambers 18, 20. The drive assembly 24 can be configured to drive pumps within the first and second pump chambers 18, 20 to pump fluid from the inlet 12 to the outlet 14. As illustrated in FIGS. 1 and 2, the drive assembly 24 can include a cover 26. The cover 26 can be positioned on a front side of the drive assembly 24. In some embodiments, the cover 26 is constructed from a transparent or translucent material (e.g., a polymer, glass, composite, or some combination thereof). Using a transparent or translucent material for the cover 26 can facilitate easier monitoring of the operation of the internal components of the drive assembly 24. The cover 26 can enclose a drive chamber 44 (FIG. 3) of the pump assembly 10. As illustrated, one or more components of the drive assembly 24 can be positioned at least partially within the drive chamber 44. In some embodiments, the drive chamber 44 is sealed (e.g., hermetically sealed) from an exterior of the pump assembly 10.

The drive assembly 24 can be positioned at least partially within a motor housing 28. In some embodiments, one or more of the drive assembly 24, first pump chamber 18, and second pump chamber 20 are positioned on a first side (e.g., front side, top side, left side, right side, back side, or bottom side) of the motor housing 28.

The pump assembly 10 can include a pump stand 32. The pump stand 32 can be configured to support the pump assembly 10 (e.g., the motor housing 28, the drive assembly 24, and/or the first and second pump chambers 18, 20). The pump stand 32 can comprise one or more legs 33 extending from motor housing 32. The legs 33 can include one or more feet 34 connected to ends of the legs 33 opposite the motor housing 28. In some embodiments, the pump assembly 10 is configured to be mounted to a wall, within a larger mounting, or otherwise.

As illustrated in FIG. 2, the motor housing 28 can include an electrical inlet 36. The electrical inlet 36 can be configured to facilitate passage of wires and other components from an exterior of the motor housing 28 into an interior of the motor housing 28. In some embodiments, the pump assembly 10 is configured to include one or more batteries to power operation of the pump assembly 10. In some such embodiments, the motor housing 28 does not include an electrical inlet. In some embodiments, the electrical inlet passes through one of the legs 33 or some other mounting device or structure of the assembly 10. The electrical inlet 36 can positioned on a back side, top side, bottom side, left side, rights side, or front side of the motor housing 28. In some embodiments, the electrical inlet 36 is connected to the drive assembly 24.

Figure 3:
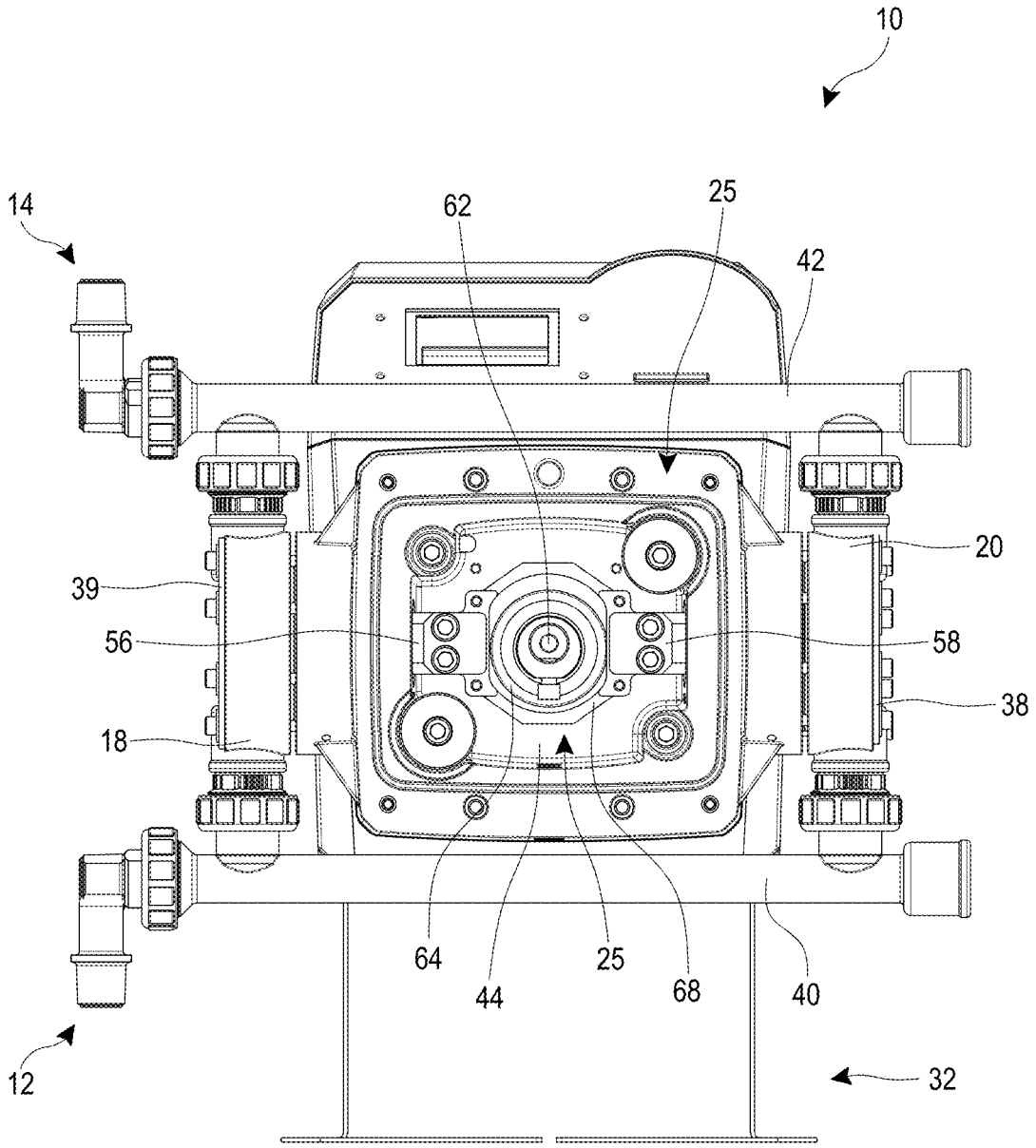
FIG. 3 is a front view of the pump assembly of FIG. 1, with the cover, shaft support, and yoke cover removed.

As illustrated in FIG. 3, the drive assembly 24 can include a drive unit 25 configured to move within the drive chamber 44. The drive unit 25 can be connected to one or more pistons. For example, the drive unit 25 can be connected to a first piston 56 and a second piston 58. The first piston 56 can be configured to affect the pressure within the first pump chamber 18. The second piston 58 can be configured to affect the pressure within the second pump chamber 20. The drive unit 25, first piston 56, second piston 58, and/or components thereof can be positioned at least partially within the drive chamber 44.

Figure 4:
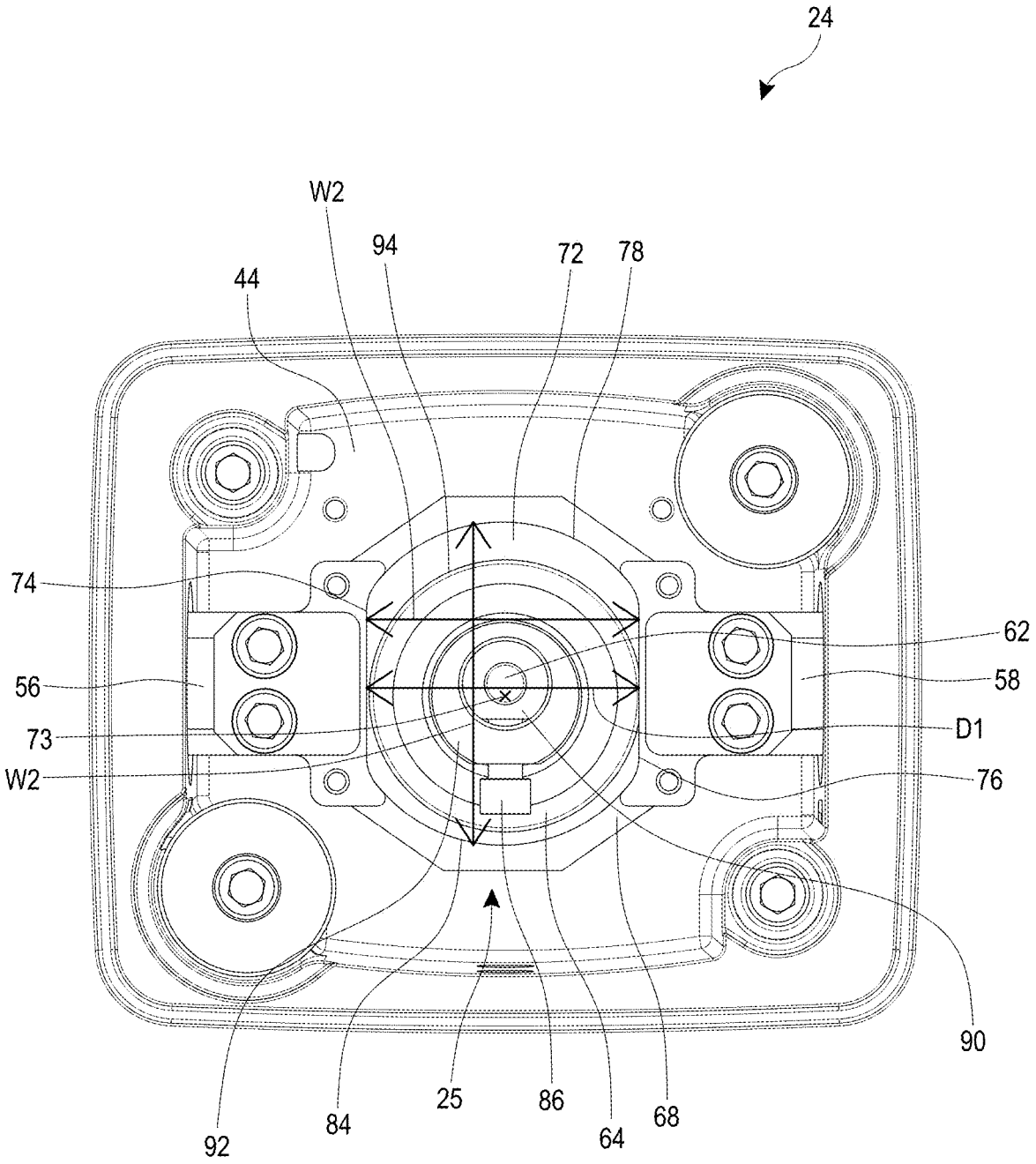
FIG. 4 is a close up view of the drive assembly of FIG. 3.
Figure 8:
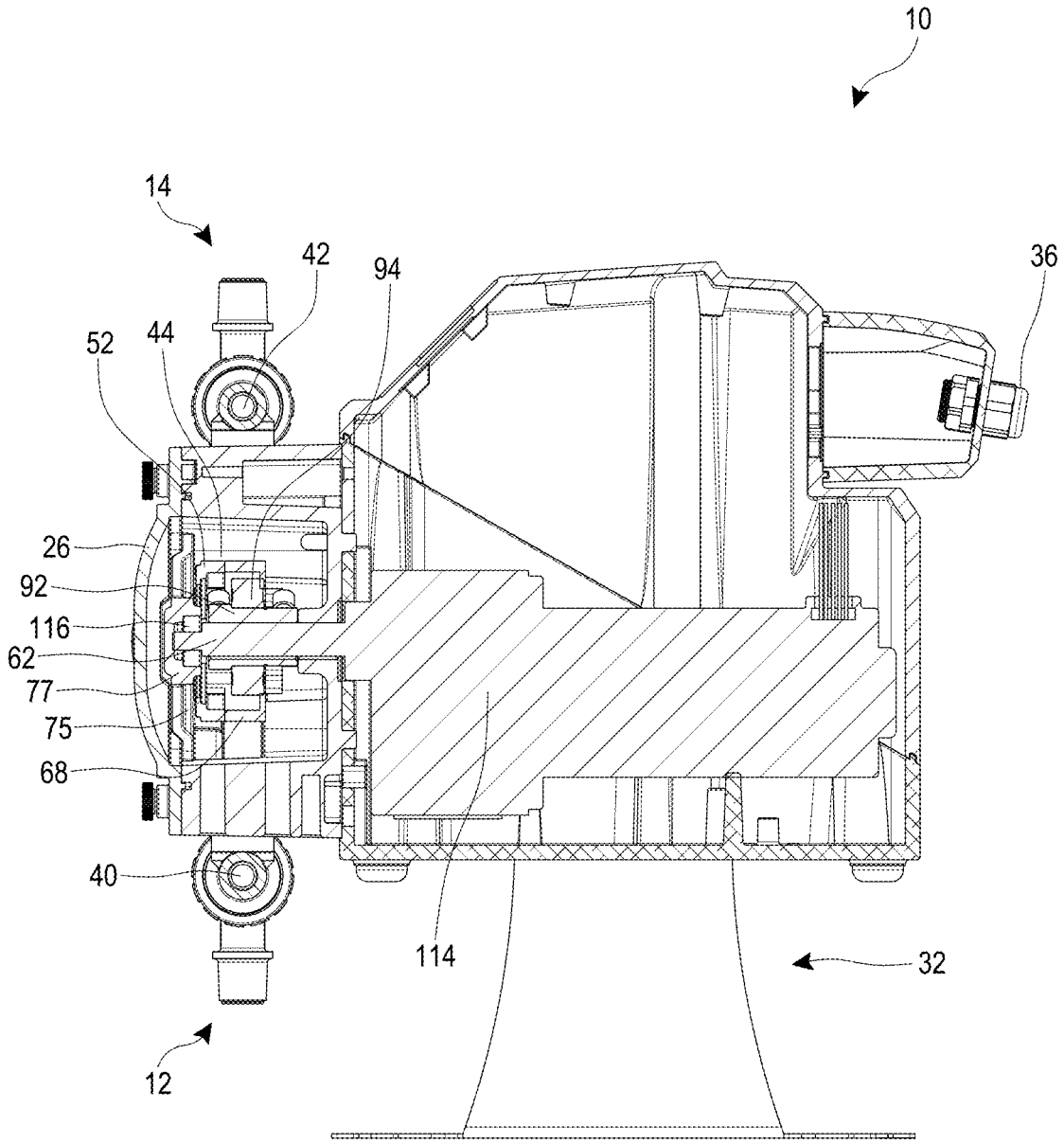
FIG. 8 is a cross-sectional view of the pump assembly of FIG. 1, taken along the cut-plane A-A of FIG. 1.

In some embodiments, the drive unit 25 includes a yoke 68. The yoke 68 can be directly or indirectly connected to one or both of the first and second pistons 56, 58. The drive unit 25 can include a cam 64. The cam 64 can be positioned at least partially within the yoke 68. The cam 64 can be connected to a drive shaft 62. The cam 64 can have a circular or substantially circular cross-sectional shape. As illustrated, the cam 64 can be offset from the drive shaft 62. For example, the center 73 (as best seen in FIG. 4) of the cam 64 can be offset from the rotational axis of the drive shaft 62 in a direction perpendicular to the rotational axis of the drive shaft 62. The drive shaft 62 can be configured to rotate in response to rotational input from the motor 114 (FIG. 8). The cam 64 can be configured to drive the yoke 68 in one or more directions in response to rotational input from the drive shaft 62. In some embodiments, the cam 64 is configured to rotate in unison with the drive shaft 62. Movement of the yoke 68, in turn, drives the first and second pistons 56, 58 in one or more directions.

As illustrated in FIG. 4, the yoke 68 can have a first wall 74, a second wall 76, a third wall 78 connecting the first and second walls, and a fourth wall 84 opposite the third wall and connecting the first and second walls. The walls of the yoke 68 can form an unbroken and/or uninterrupted perimeter surrounding a yoke pocket 72. Using a yoke 68 having a continuous perimeter can facilitate reliable movement of the pistons 56, 58 and can reduce the likelihood of failure of the yoke 68. The cam 64 (e.g., the offset cam) can be positioned partially or entirely within the yoke pocket 72 when observed from a point of view along the rotational axis of the drive shaft 62. The cam 64 can have an outer diameter D1. The outer diameter D1 of the cam 64 can be less than a distance W1 between the first and second walls 74, 76 of the yoke 68. In some embodiments, the outer diameter D1 of the cam 64 is between 60%-80%, between 75%-95%, between 85%-97%, between 96%-99%, and/or between 98%-99.5% of the distance W1 between the first and second walls 74, 76. In some embodiments, the outer diameter D1 of the cam 64 is less than the distance W1 between the first and second walls 74, 76 and the difference between the outer diameter D1 and the distance W1 is less than 10%, less than 8%, less than 6%, less than 4%, less than 2%, less than 1%, less than 0.5%, and/or less than 0.25% of the distance W1 between the first and second walls 74, 76 of the yoke 68.

In some embodiments, one or both of the first and second walls 74, 76 are flat. The first and second walls 74, 76 of the yoke 68 can be parallel to each other. As illustrated, the first and second walls 74, 76 of the yoke 68 can be perpendicular to direction of movement of the pistons 56, 58. In some embodiments, the cam 64 is sized such that, in the frame of reference of the yoke 68, the cam 64 does not travel a significant distance in a direction perpendicular to the walls 74, 76. For example, the diameter D1 of the cam 64 can be very close (e.g., within 5%, within 3%, within 1%, within 0.5%, and/or within 0.25%) of the distance W1 between the first and second walls 74, 76, such that there is very little room for the cam 64 to travel with respect to the yoke 68 in a direction perpendicular to the first and second walls 74, 76 of the yoke 68. Minimizing the travel of the cam 64 toward and away from the first and second walls 74, 76 can reduce impact of the cam 64 on those walls, thereby reducing noise and/or wear on the first and second walls 74, 76. One or more of the first wall 74, second wall 76, and outer surface of the offset cam 64 can be formed from and/or coated with a low friction and/or high toughness material to reduce the likelihood of failure of the offset cam 64 or walls of the yoke 68.

As explained above, the offset cam 64 is configured to rotate with the drive shaft 62. Preferably, rotation of the drive shaft 62 moves the center 73 of the offset cam 64 in a circular or arcuate path. Movement of the center 73 of the offset cam 64 causes the offset cam 64 to push against the first wall 74 over a portion (e.g., approximately ½ of a revolution of the drive shaft 62) of the rotation of the drive shaft 62 and to push against the second wall 76 over another portion (e.g., approximately ½ of a revolution of the drive shaft 62) of the rotation of the drive shaft 62. As the drive shaft rotates 62, the offset cam 64 can also move up and down (e.g., in the frame of reference of FIG. 4 and/or parallel to the first and second walls 74, 76) within the yoke pocket 72. To accommodate this motion, the distance W2 between the third and fourth walls 78, 82 (e.g., the max distance) can be greater than the diameter D1 of the offset cam 64. For example, the distance W2 between the third and fourth walls 78, 82 can be at least 10%, at least 15%, at least 20%, and/or at least 25% greater than the diameter D1 of the offset cam 64. The drive assembly 24 can be configured to operate with little or no lubrication. In some embodiments, the drive chamber 44 is a dry environment. Reducing or eliminating the need for lubricant or hydraulic environments can reduce the cost of the pump assembly 10 and reduce maintenance costs.

As illustrated in FIG. 4, the drive unit 25 can include a linkage 86 between the drive shaft 62 and the offset cam 64. The linkage 86 can be configured to rotationally lock the offset cam 64, or some portion thereof, to the drive shaft 62. For example, the linkage 86 can be a fastener inserted through an inner cam portion 92 and in contact with or extending through a portion of the outer portion 90 of the drive shaft 62.

Figure 9:
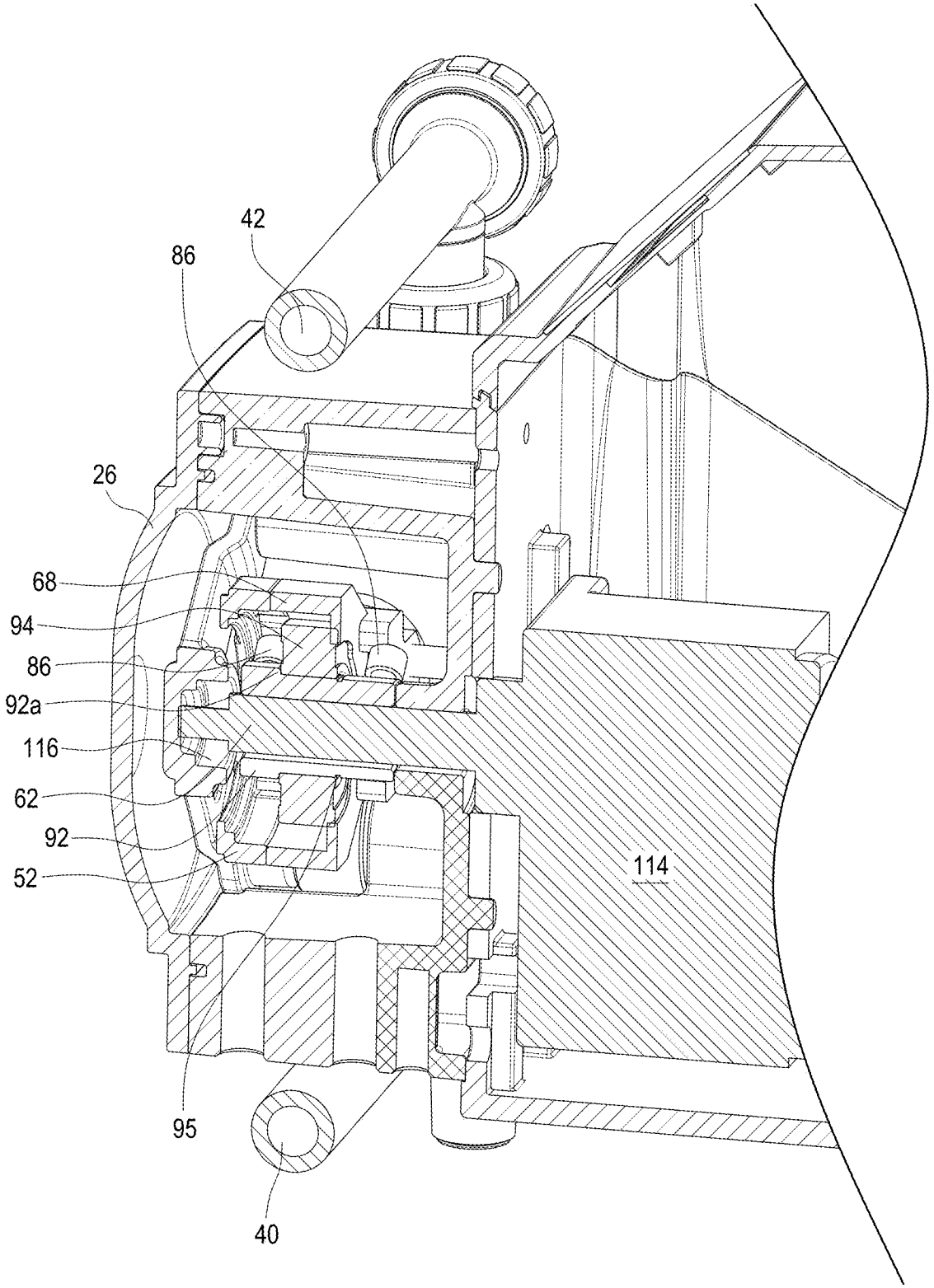
FIG. 9 is a perspective cross-sectional view of the pump assembly of FIG. 1, taken along the cut-plane A-A of FIG. 1.

A bearing 94 can be positioned surrounding the inner cam portion 92. In some embodiments, the bearing 94 is press-fit onto the inner cam portion 92. As illustrated in FIG. 9, the bearing 94 is positioned between a shoulder 92*a* of the inner cam portion 92 and a snap ring 95. The snap ring 95 can fit into a groove in an outer surface of the inner cam portion 92. In some embodiments, two linkages 86 are used to lock the inner cam portion 92 to the drive shaft 62. As illustrated, one linkage 86 can be positioned in front of the bearing 94 and a second linkage 86 can be positioned behind the bearing 94. The bearing 94 can form the contact surface of the offset cam 64 with the walls of the yoke 68. In some embodiments, the contact surface of the offset cam 64 is configured to rotate with respect to the inner cam portion 92. Rotation of the outer surface of the offset cam 64 with respect to the inner cam portion 92 and/or drive shaft 62 can reduce the friction between the offset cam 64 and the yoke 68. Reduction of friction between the offset cam 64 and the yoke 68 can reduce or eliminate the need for lubricant or other fluids in the drive chamber 44 between the offset cam 64 and yoke 68.

Figure 5:
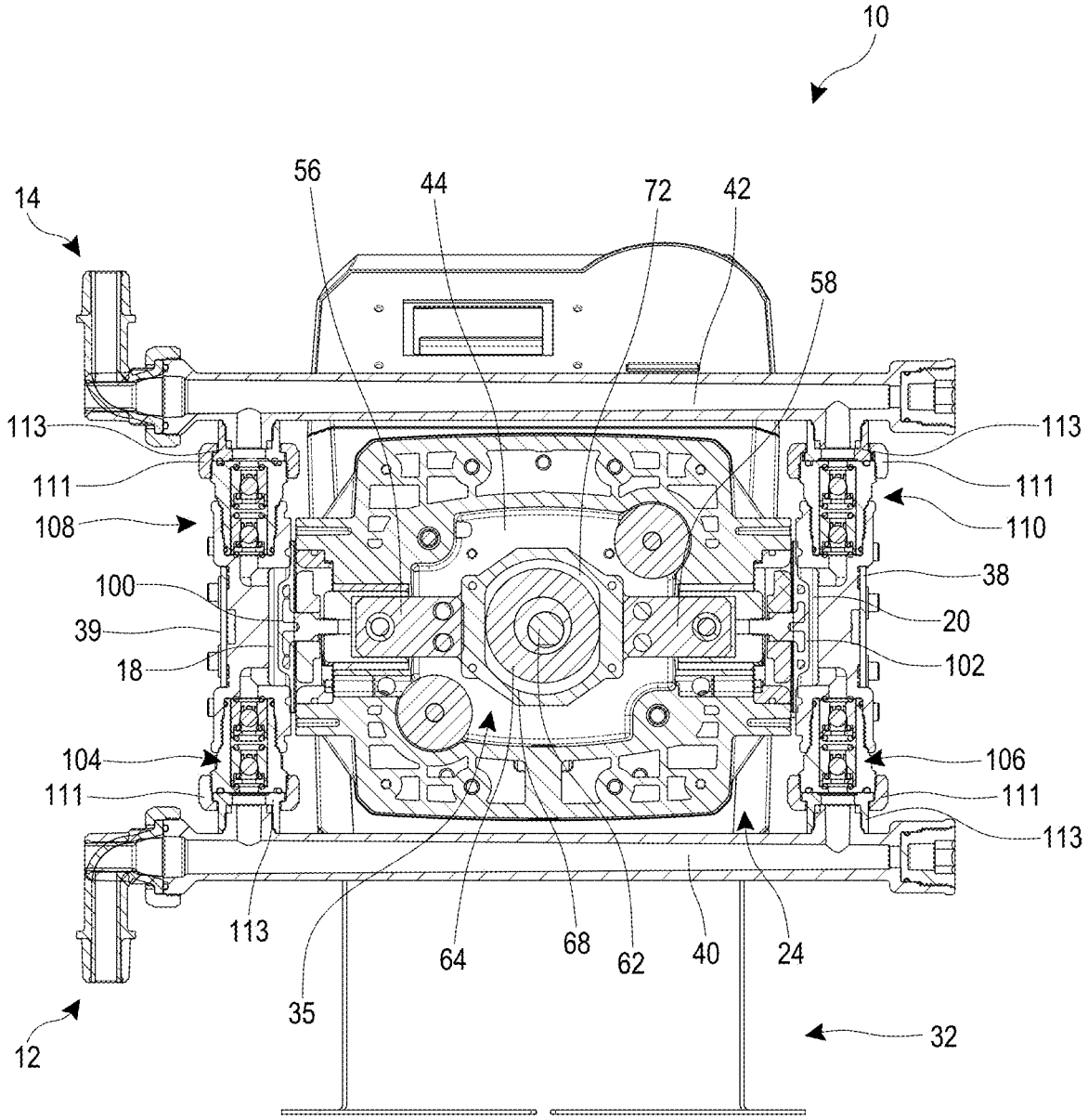
FIG. 5 is a cross-sectional view of the pump assembly of FIG. 1, taken along the cut-plane B-B of FIG. 2.

As illustrated in FIG. 5, the first piston 56 can be connected, directly or indirectly, to a first diaphragm 100 (e.g., a flexible wall). The second piston 58 can be connected to a second diaphragm 102 (e.g., a flexible wall). The first diaphragm 100 can form a portion of the boundary for the first pump chamber 18. The second diaphragm 102 can form a portion of the boundary for the second pump chamber 20.

The pump assembly 10 can include one or more one-way valves. For example, a first one-way valve 104 can be positioned in the fluid path between the inlet 12 and the first pump chamber 18. In some embodiments, the first one-way valve 104 is positioned in the fluid path between the inlet connector passage 40 and the first pump chamber 18. The first one-way valve 104 can be configured to inhibit or prevent flow from the first pump chamber 18 toward the inlet 12 and to allow flow from the inlet 12 into the first pump chamber 18. In some embodiments, the first one-way valve 104 is configured to permit fluid flow into the first pump chamber 18 from the inlet 12 when a cracking pressure is exceeded. A second one-way valve 106 can be positioned in the fluid path between the inlet 12 or inlet connector passage 40 and the second pump chamber 20. The second one-way valve 106 can be configured to operate in a same or similar manner as the first one-way valve 104 with respect to the second pump chamber 20 instead of the first pump chamber 18. A third one-way valve 108 can be positioned in the fluid path between the first pump chamber 18 and the outlet 14 or outlet connector passage 42. The third one-way valve 108 can inhibit or prevent fluid flow into the first pump chamber 18 from the outlet 14 or outlet connector passage 42. The third one-way valve 108 can be configured to permit flow from the first pump chamber 18 to the outlet 14 or outlet connector passage 42 when a cracking pressure is exceeded. The pump assembly 10 can include a fourth one-way valve 110 positioned in the fluid path between the second pump chamber 20 and the outlet 14 or outlet connector passage 42. The fourth one-way valve 110 can be configured to operate in the same or a similar manner as the third one-way valve 108 with respect to the second pump chamber 20 instead of the first pump chamber 18.

In some embodiments, union nuts 111 can be used to connect the one-way valves (e.g., the housings of the one-way valves) to ports 113 on the inlet and outlet connector passages 40, 42. The union nuts 111 can be spin-welded or otherwise affixed to the ports 113. Affixing the union nuts 111 to the ports 113 reduces the likelihood of loosening the connection between the one-way valves and the ports 113, thereby reducing the risk of leaks.

Figure 6:
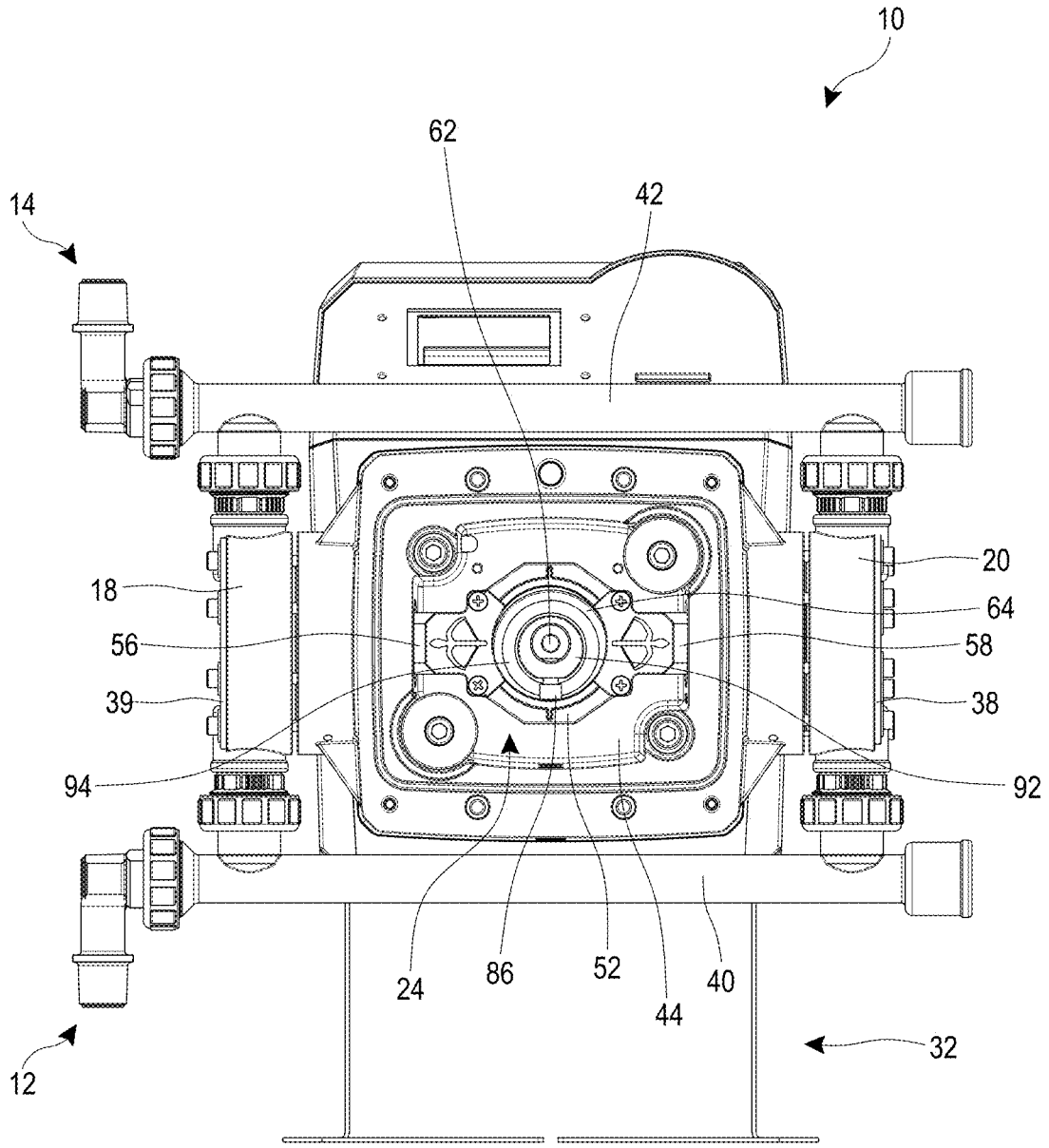
FIG. 6 is a front view of the pump assembly of FIG. 1, with the cover and shaft support removed.

As illustrated in FIG. 6, the drive assembly 24 can include a yoke cover 52. The yoke cover 52 can connect the yoke 68 to the pistons 56, 58. In some embodiments, the yoke cover 52 is configured to lock the yoke 68 to the pistons 56, 58 such that movement of the yoke 68 moves the pistons 56, 58 in unison with each other. The yoke cover 52 can be connected to the yoke 68 and pistons 56, 58 via one or more fasteners, welding, adhesives, clips, and/or other attachment methods and structures.

Figure 7:
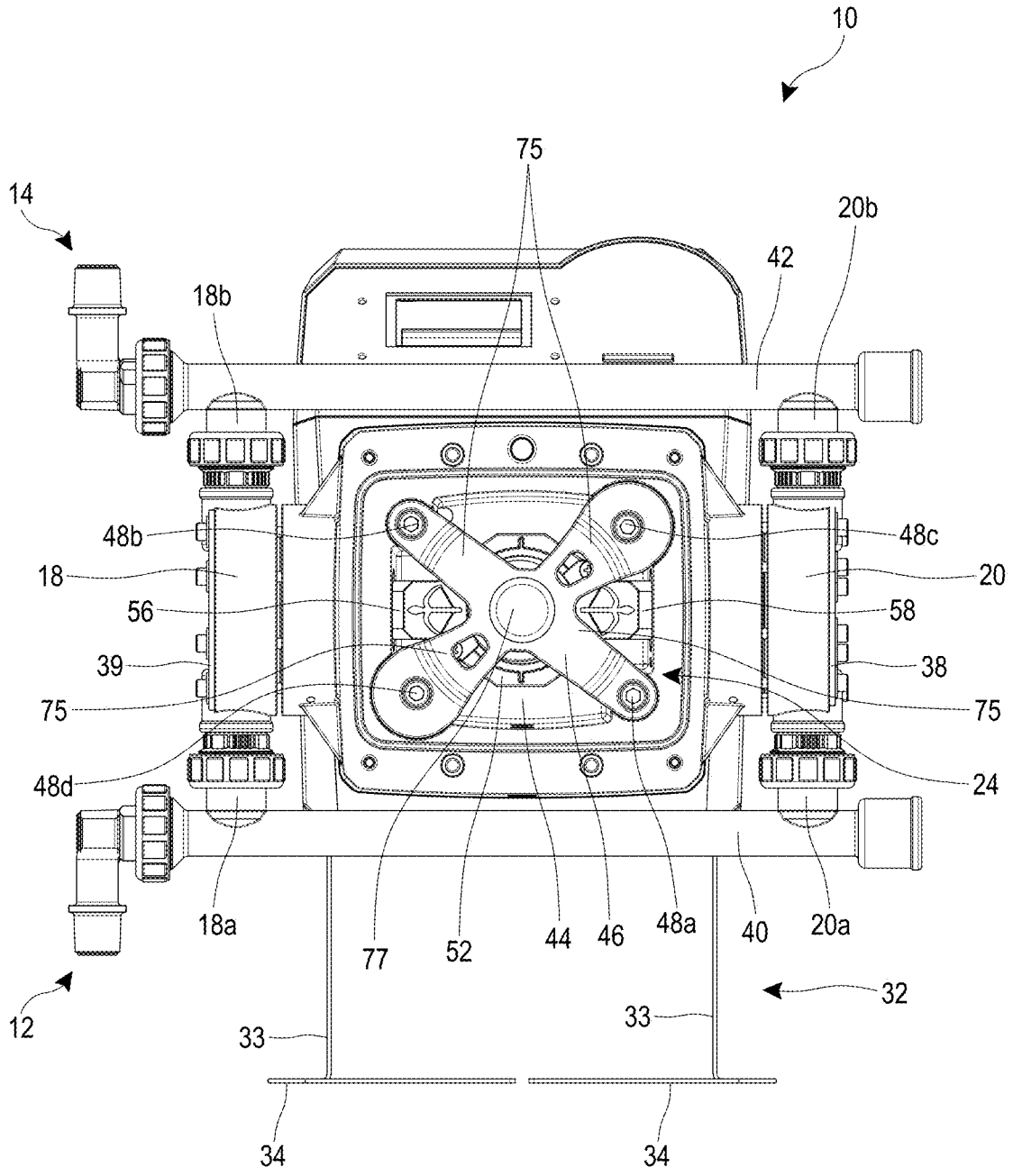
FIG. 7 is a front view of the pump assembly of FIG. 1, with the cover removed.

As illustrated in FIG. 7, the drive assembly 24 can include a shaft support 46. The shaft support 46 can include a central portion 77 and plurality of outer arms 75. Each of the arms 75 of the shaft support 46 can be connected to the motor housing 38 or other structure of the pump assembly 10. As illustrated, the shaft support 46 can have four arms 75 that can be connected to the motor housing 38 via four attachment points 48*a*, 48*b*, 48*c*, and 48*d*. The four attachment points can be arranged such that two pairs of attachment points (48*a*-48*b*, 48*c*-48*d*) each span the yoke 68. Arranging the attachment points spanning the yoke 68 in at least two pairs can facilitate even distribution of angular load on the shaft support 46 as the drive shaft 62 rotates in operation. Distributing load on the shaft support 46 in an even manner can reduce flexing of the drive shaft 62, thereby reducing the likelihood of drive shaft 62 failure. As illustrated in FIG. 8, the shaft support 46 (e.g., the central portion 77 of the shaft support 46) can connect to an end of the drive shaft 62 opposite the motor 114. The connection point between the drive shaft 62 and the shaft support 46 can be fixed. For example, the shaft support 46 can inhibit or prevent translation of the drive shaft in any direction perpendicular to the axis of rotation of the drive shaft 62. A bearing 116 can be positioned about the drive shaft 62 where the drive shaft 62 meets the shaft support 46. The bearing 116 can be a needle bearing, a ball bearing, or any other suitable bearing. The bearing 116 can be fixed in the directions perpendicular to the axis of rotation of the drive shaft 62. Fixing the bearing 116 and drive shaft 62 in directions perpendicular to the axis of rotation of the drive shaft 62 can increase stability of the drive shaft, increase durability of the bearing 116, reduce asymmetrical loading on the bearing 116 in directions perpendicular to the axis of rotation of the drive shaft 62, and/or reduce bending stress on the drive shaft 62. In some embodiments, this bearing 116 is the only load-bearing bearing used in connection with the drive shaft 62, offset cam 64, and yoke 68. Using only a single load-bearing bearing in this manner can reduce points of failure in the assembly 10 and increase the durability and/or reliability of the pump assembly 10. In some embodiments, the engagement between the drive shaft 62 and the shaft support 46 (e.g., the central portion 77 of the shaft support 46) does not include any bearings. For example, the drive shaft 62 and/or shaft support 46 can include low-friction surfaces at all or a portion of the interface between the drive shaft 62 and the shaft support 46.

The pump assembly 10 can be configured to operate in the following manner. As the drive shaft 62 rotates, the offset cam 64 can rotate and move toward the first pump chamber 18. Movement of the offset cam 64 toward the first pump chamber 18 can apply a pushing force on the first wall 74 of the yoke 68. Pushing on the first wall 74 can translate into a pushing force on the first piston 56. Pushing on the first piston 56 can push on the first diaphragm 100, thereby reducing the volume within the first pump chamber 18. Reduction in the volume of the first pump chamber 18 can increase the pressure in the first pump chamber 18, thereby opening the third one-way valve 108 to push fluid from the first pump chamber 18 toward the outlet. Concurrent with the pushing of the first piston 56 toward the first pump chamber 18, the second piston 58 is pulled by the yoke 68 away from the second pump chamber 20. Pulling of the second piston 58 away from the second pump chamber 20 pulls the second diaphragm 102 away from the second pump chamber 20 to increase the volume in the second pump chamber 20. Increasing the volume in the second pump chamber 20 reduces the pressure in the second pump chamber 20, causing the second one-way valve 106 to open and to allow fluid flow from the inlet 12 into the second pump chamber 20. As the drive shaft 62 continues to rotate, the cam 64 also rotates until it begins pushing against the second wall 76 of the yoke 68. This pushing on the second wall 76 causes the opposite movements and respective pressure changes from those described above in this paragraph. As such, as the drive shaft 62 completes is revolutions, the pump chambers 18, 20 alternately pull in fluid from the inlet 12 and push out fluid to the outlet 14.

The streamline designs of the pumps of the present disclosure allow for a number of additional advantages. For example, due to the relatively low number of parts, assembly of the pump assembly 10 can be accomplished quickly. Additionally, use of fewer parts (e.g., fewer moving parts, bearings, etc.) can increase the reliability of the pump assembly, as the potential points of failure are reduced.

Figure 10:
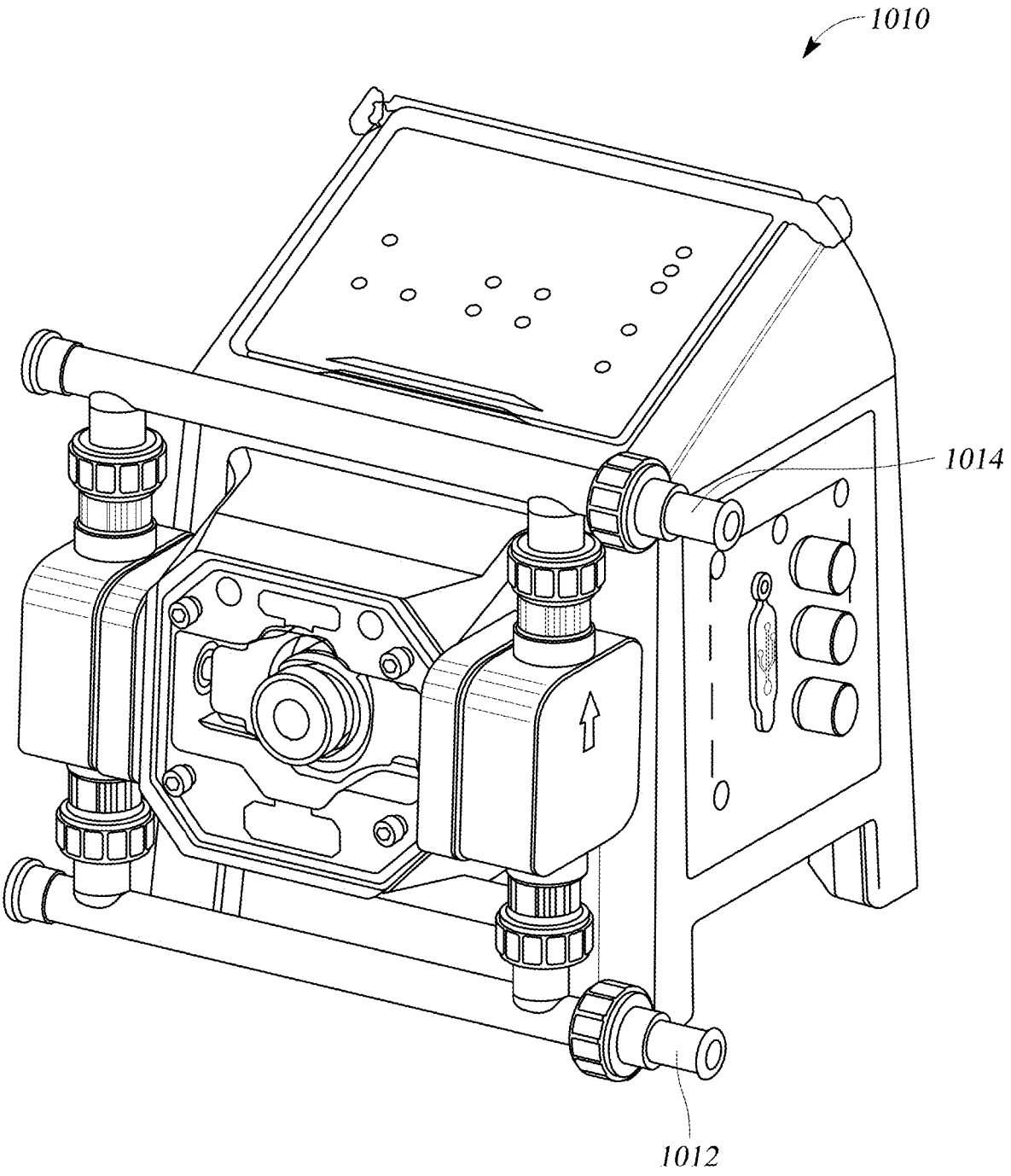
FIG. 10 is a perspective view of an example pump assembly.

FIG. 10 is another example of a pump assembly 1010 according to the present disclosure. The pump assembly 1010 can be similar to the pump assemblies described herein, but with the inlet 1012 and outlet 1014 on the opposite side (e.g., in FIG. 10, inlet 1012 and outlet 1014 are shown on the right side of the page instead of the left side). The other components can be similar to those described with respect to FIGS. 1-9.

Figure 11:
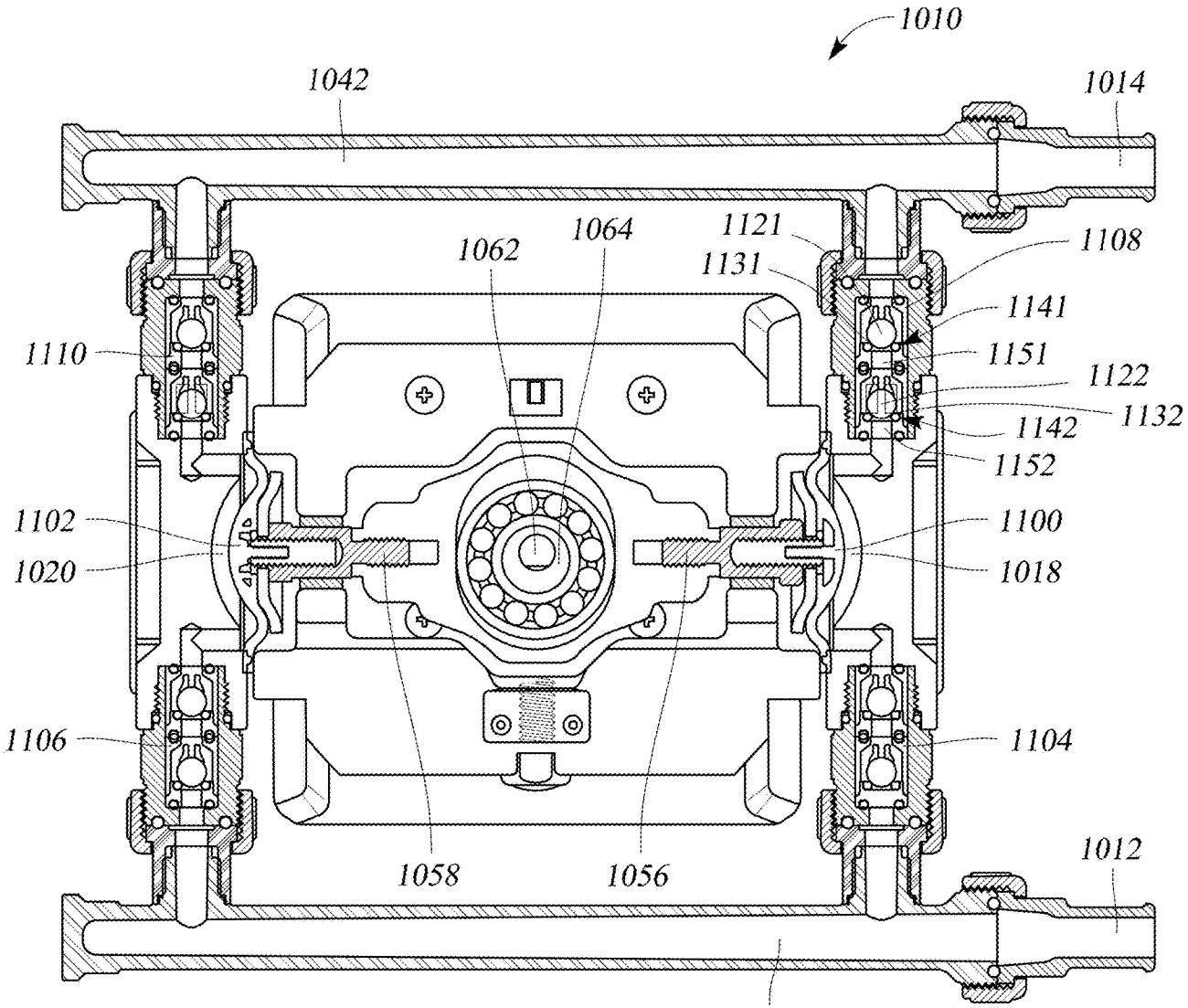
FIG. 11 is a front view of example components that can be within the pump assembly of FIG. 10.

For example, FIG. 11 shows a cross-sectional view of example components of the pump assembly 1010 of FIG. 10. The pump assembly 1010 can include an assembly inlet 1012, an assembly outlet 1014, a first pump chamber 1018 positioned in a first fluid path between the assembly inlet 1012 and outlet 1014, and a second pump chamber 1020 positioned in a second fluid path between the assembly inlet 1012 and outlet 1014. An inlet connector passage 1040 can extend between the inlets of the first pump chamber 1018 and the second pump chamber 1020. An outlet connector passage 1042 can extend between the outlets of the first pump chamber 1018 and the second pump chamber 1020. A first diaphragm 1100 (e.g., a flexible wall) can be positioned at least partially within the first pump chamber 1018, e.g., at a rest position. The first diaphragm 1100 can be sealingly connected (e.g., having a perimeter sealingly connected) to one or more walls of the first pump chamber 1018. A second diaphragm 1102 (e.g., a flexible wall) can be positioned at least partially within the second pump chamber 1020, e.g., at a rest position. The second diaphragm 1102 can be sealingly connected (e.g., having a perimeter sealingly connected) to one or more walls of the second pump chamber 1020.

A first piston 1056 can be connected to the first diaphragm 1100. The first piston 1056 can be movable. In various designs, the first piston 1056 can be movable linearly (e.g., in a horizontal direction or substantially horizontal direction in FIG. 11). A second piston 1058 can be connected to the second diaphragm 1102. The second piston 1058 can be movable. In various designs, the second piston 1058 can be movable linearly (e.g., in a horizontal direction or substantially horizontal direction in FIG. 11). As described herein, movement of the first piston 1056 toward the first pump chamber 1018 can force a portion of the first diaphragm 1100 to move from its rest position to a position further within the first pump chamber 1018 and to increase pressure in the first pump chamber 1018. Movement of the first piston 1056 toward the first pump chamber 1018 can also force a portion of the second diaphragm 1102 to move from its rest position to a position away from the second pump chamber 1020 and to reduce pressure in the second pump chamber 1020. As also described herein, movement of the second piston 1058 toward the second pump chamber 1020 can force a portion of the first diaphragm 1100 to move from its rest position to a position away from the first pump chamber 1018 and to reduce a pressure in the first pump chamber 1018. Movement of the second piston 1058 toward the second pump chamber 1020 can force a portion of the second diaphragm 1102 to move from its rest position to a position further within the second pump chamber 1020 and to increase pressure in the second pump chamber 1020.

As described herein, the pump assembly 1010 can include a motor (e.g., motor 114 in FIG. 8) and a motor drive shaft 1062 connected to the motor. A cam 1064 can be connected to the motor drive shaft 1062. In some instances, the cam can be an offset cam. The cam 1064 can be configured to rotate in unison with the motor drive shaft 1062. In some designs, the cam 1064 can be configured to push the first piston 1056 in a first direction toward the first pump chamber 1018 (e.g., in a horizontal or substantially horizontal direction in FIG. 11) during a first portion of one rotation of the motor drive shaft 1062 and to push the second piston 1058 in a second direction toward the second pump chamber 1020 (e.g., in a horizontal or substantially horizontal direction in FIG. 11) during a second portion of one rotation of the motor drive shaft 1062. The first direction and the second direction can be collinear.

The pump assembly 1010 can include one or more check valves (e.g., one or more one-way valves). For example, a first check valve 1104 can be positioned in the fluid path between the assembly inlet 1012 and the first pump chamber 1018. In some embodiments, the first check valve 1104 can be positioned in the fluid path between the inlet connector passage 1040 and the first pump chamber 1018. The first check valve 1104 can be configured when in a closed position to reduce, inhibit, or prevent flow from the first pump chamber 1018 toward the assembly inlet 1012 and when in an opened position to permit or allow fluid flow from the assembly inlet 1012 into the first pump chamber 1018. In some embodiments, the first check valve 1104 can be configured to permit fluid flow into the first pump chamber 1018 from the assembly inlet 1012 when a cracking pressure is exceeded.

A second check valve 1108 can be positioned in the fluid path between the first pump chamber 1018 and the assembly outlet 1014 or outlet connector passage 1042. The second check valve 1108 can when in a closed position reduce, inhibit, or prevent fluid flow into the first pump chamber 1018 from the assembly outlet 1014 or outlet connector passage 1042. The second check valve 1108 can be configured when in an opened position to permit fluid flow from the first pump chamber 1018 to the assembly outlet 1014 or outlet connector passage 1042 when a cracking pressure is exceeded.

A third check valve 1106 can be positioned in the fluid path between the assembly inlet 1012 or inlet connector passage 1040 and the second pump chamber 1020. The third check valve 1106 can be configured to operate in a same or similar manner as the first check valve 1104 with respect to the second pump chamber 1020 instead of the first pump chamber 1018.

The pump assembly 1010 can include a fourth check valve 1110 positioned in the fluid path between the second pump chamber 1020 and the assembly outlet 1014 or outlet connector passage 1042. The fourth check valve 110 can be configured to operate in the same or a similar manner as the second check valve 1108 with respect to the second pump chamber 1020 instead of the first pump chamber 1018.

Figure 12:
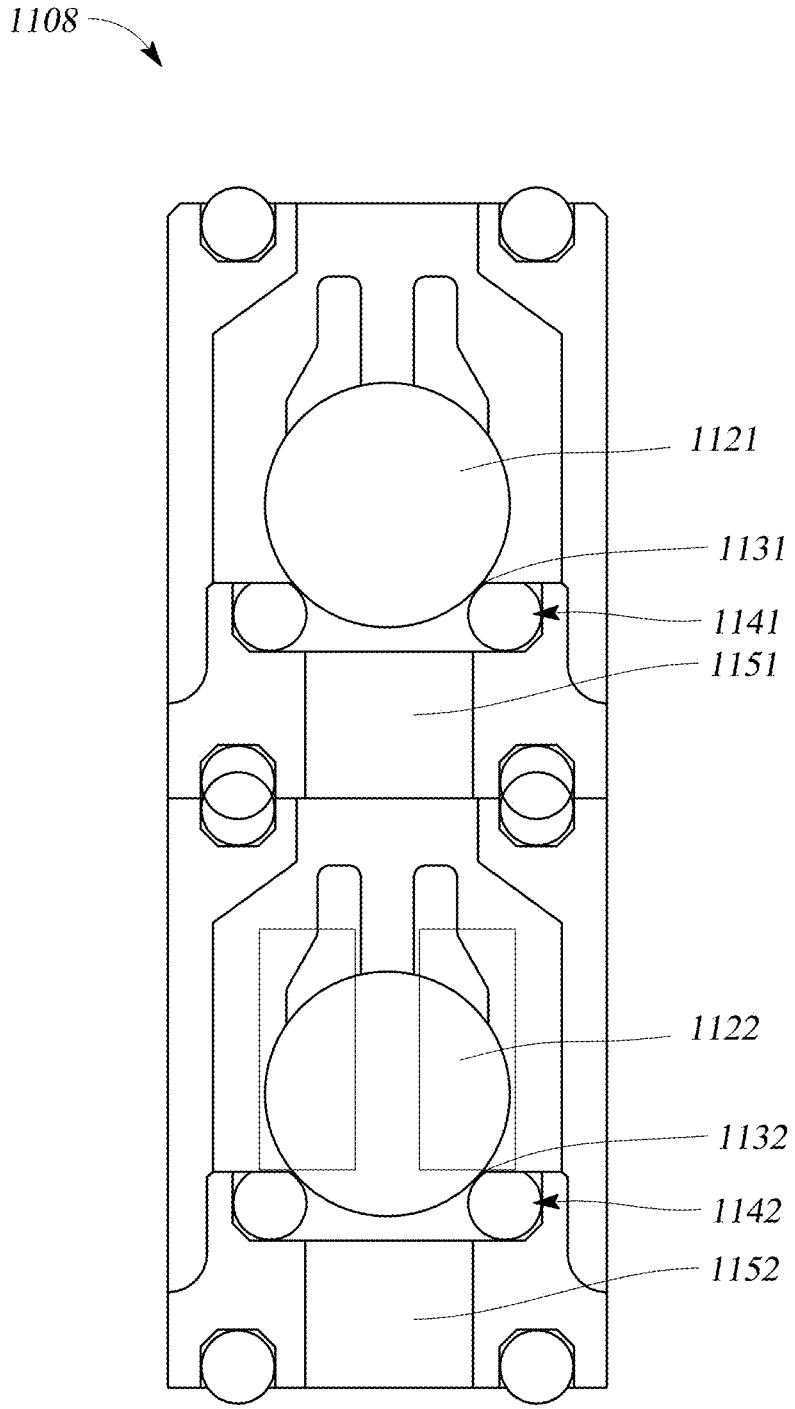
FIG. 12 is a close up view of an example check valve within the pump assembly of FIG. 11.

FIG. 12 is a close up view of the second check valve 1108. As shown in FIGS. 11 and 12, each check valve (e.g., as shown with respect to the second check valve 1108), can include a spherical ball 1121 and a seat opening 1131. It will be understood that the surface of the seat defining the opening has the same shape and, thus, the same radius as the opening. The spherical ball 1121 can contact the seat opening 1131 when in the closed position. In some cases, the seat opening 1131 can be provided by at least one O-ring 1141 (e.g., the opening of at least one O-ring 1141). The O-ring 1141 can create a seal with the spherical ball 1121 when in contact such that the check valve 1108 can be sealed in the closed position. As such, in the closed position, there may be no gap between the spherical ball 1121 and seat opening 1131.

As shown in FIGS. 11 and 12, each check valve (e.g., as shown with respect to the second check valve 1108), can include a second spherical ball 1122 and a second seat opening 1132. The second spherical ball 1122 can contact the second seat opening 1132 when in the closed position. In some cases, the second seat opening 1132 can be provided by at least one O-ring 1142 (e.g., the opening of at least one O-ring 1142). The O-ring 1142 can create a seal with the second spherical ball 1122 when in contact. As such, in the closed position, there may be no gap between the second spherical ball 1122 and second seat opening 1132.

With reference to FIG. 11, when the first piston 1056 moves toward the first pump chamber 1018, the pressure in the first pump chamber 1018 increases. At a cracking pressure, the seal between the spherical balls 1121, 1122 and its respective seat openings 1131, 1132 can break open, causing the spherical balls 1121, 1122 to move away from its respective seat openings 1131, 1132 and allowing the fluid to flow through the check valve 1018 and towards the outlet connector passage 1042 and/or assembly output 1014. When the first piston 1056 moves away from the first pump chamber 1018, the pressure in the first pump chamber 1018 reduces. The spherical balls 1121, 1122 can move back toward its respective seat openings 1131, 1132, and form a seal therebetween. In the closed position, the fluid does not flow through the check valve 1108.

When the check valve 1108 has been in a closed position for a long time (e.g., when the assembly has been turned off), gases (e.g., any gases that are produced when pumping chemicals that off-gasses such as NaOCl) can accumulate and get trapped in the check valve 1108, for example in the regions 1151, 1152 below the O-rings 1141, 1142. The pressure from the gas trapped, e.g., in the region 1151 between the O-rings 1141, 1142 can especially build up such that the spherical balls 1121, 1122 may no longer move away from its respective seat openings 1131, 1132. As such, pressure can also build up from the gas trapped below the O-ring 1142. The trapped gas in these regions 1151, 1152 can result in a vapor lock situation.

Figure 13:
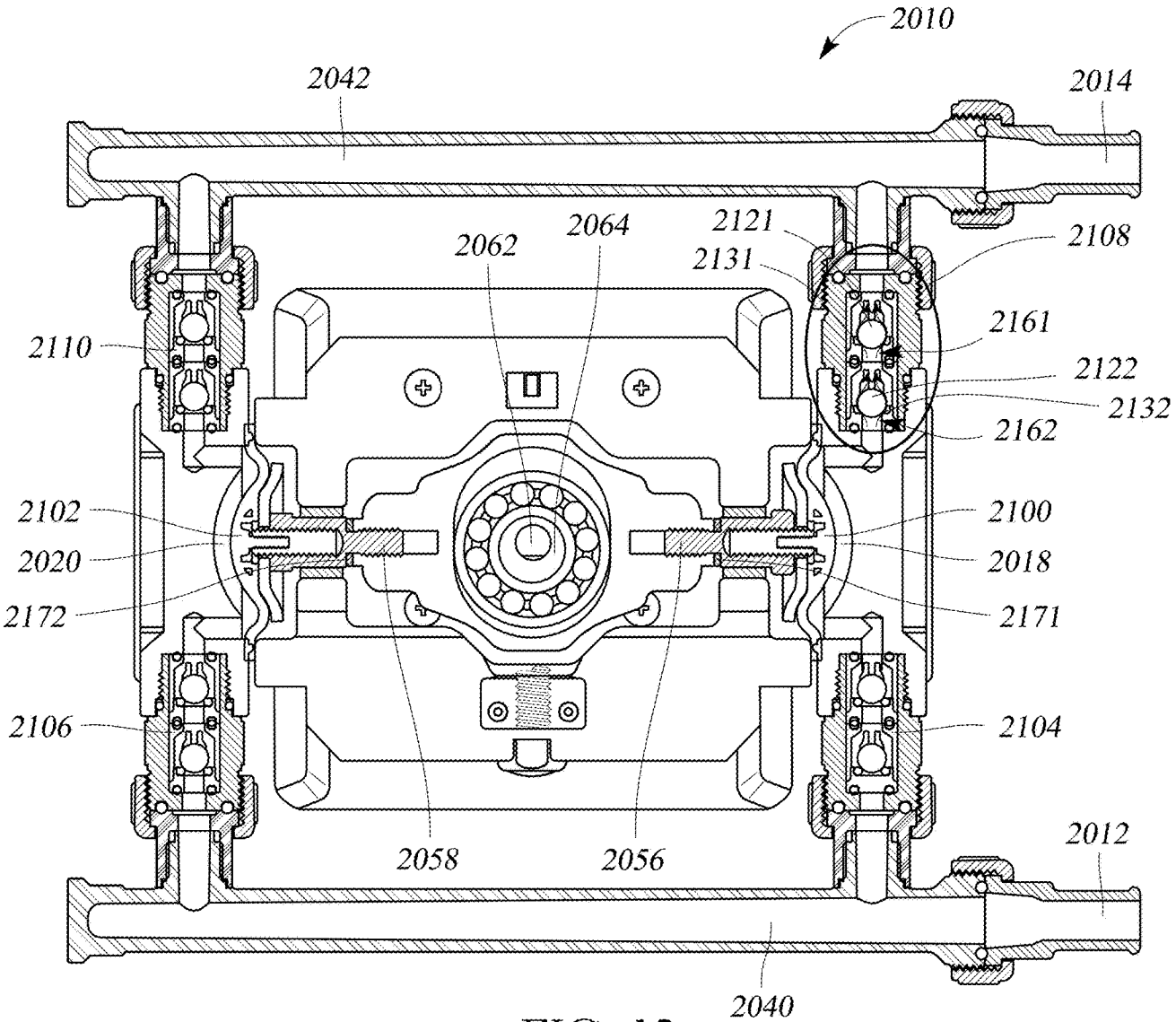
FIG. 13 is a front view of another example of components that can be within the pump assembly of FIG. 10.

FIG. 13 shows a cross-sectional view of another example of possible components within the pump assembly of FIG. 10. The pump assembly 2010 can be similar to the pump assemblies described herein, but with the modification that one or more of the check valves 2104, 2106, 2108, 2110 can be a degassing valve (e.g., a valve configured to release gas). A degassing valve can allow gas to seep through the check valve. A pump assembly 2010 with one or more degassing check valves can reduce the likelihood of gas becoming trapped in the check valve (e.g., and resulting in vapor lock), and can provide a check valve filled with liquid chemical NaOCl or other chemicals that may produce an out-gas.

In FIG. 13, one of the outlet check valves 2108 is a degassing valve. In some designs, both of the outlet check valves 2108, 2110 can be degassing valves. In some designs, one or more of the inlet check valves 2104, 2106 can be a degassing valve. In some instances, all of the check valves 2104, 2106, 2108, 2110 can be a degassing valve. Various combinations of designs are possible.

Figure 14:
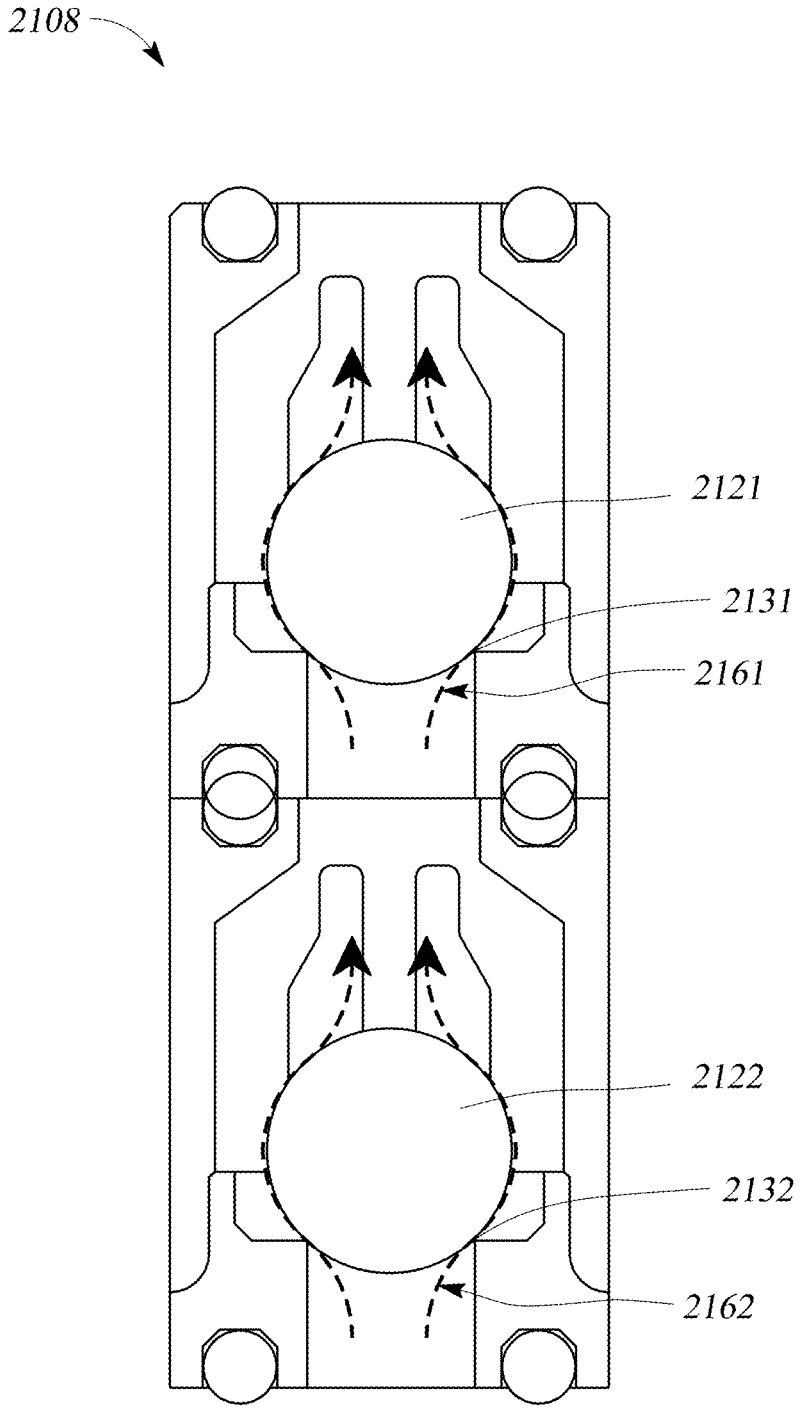
FIG. 14 is a close up view of an example check valve within the pump assembly of FIG. 13.

FIG. 14 is a close up view of the example degassing valve, e.g., the second check valve 2108 in FIG. 13. In the closed position, the check valve 2108 can be unsealed (e.g., without one or more O-rings) to provide one or more escape paths 2161, 2161 for any accumulated gas. The check valve 2108 can include a spherical ball 2121 and a seat opening 2131. The spherical ball 2121 can contact the seat opening 2131 when in the closed position. Instead of one or more O-rings providing the seat opening (as for check valve 1108 in FIG. 12), the seat opening 2131 in check valve 2108 can be provided by a seat formed by one or more interior surfaces of the valve 2108. For example, the check valve 2108 can have one or more interior surfaces extending along the longitudinal direction. The seat opening 2131 can be formed by one or more interior surfaces extending in the transverse direction. In the closed position, unlike check valve 1108 in FIG. 12, the check valve 2108 in FIG. 14 (e.g., without one or more O-rings) can have a gap between the spherical ball 2121 and seat opening 2131. The gap can provide an escape path for any off-gases produced by chemicals. Again, it will be understood that the surface of the seat defining the opening has the same shape and, thus, the same radius as the opening.

In various implementations, the gap can have a size based on the desired gas flow rate. In some designs, the size of the gap can be at least 0.2 micron (or 8 micro-inches), at least 0.4 micron (or 16 micro-inches), at least 0.8 micron (or 32 micro-inches), or at least 1.6 microns (or 63 micro-inches). In some designs, the size of the gap can be no larger than 0.4 micron (or 16 micro-inches), no larger than 0.8 micron (or 32 micro-inches), no larger than 1.6 microns (or 63 micro-inches), or no larger than 3.2 microns (or 125 micro-inches). In some designs, the size of the gap can be in a range formed by any of these values, e.g., from 0.2 micron (or 8 micro-inches) to 0.4 micron (or 16 micro-inches), from 0.2 micron (or 8 micro-inches) to 0.8 micron (32 micro-inches), from 0.2 micron (or 8 micro-inches) to 1.6 microns (or 63 micro-inches), from 0.2 micron (or 8 micro-inches) to 3.2 microns (or 125 micro-inches), or from 0.4 micron (or 16 micro-inches) to 0.8 micron (32 micro-inches). Other examples are possible.

In some designs, the size of the cross-sectional area of the gap can be at least 2800 $\mu m^2$, at least 5600 $\mu m^2$, at least 11,300 $\mu m^2$, or at least 22,700 $\mu m^2$. In some designs, the size of the gap can be no larger than 5700 $\mu m^2$, no larger than 11,400 $\mu m^2$, no larger than 22,800 $\mu m^2$, or no larger than 45,500 $\mu m^2$. In some designs, the size of the gap can be in a range formed by any of these values, e.g., from 2800 $\mu m^2$ to 5700 $\mu m^2$, from 2800 $\mu m^2$ to 11,400 $\mu m^2$, from 2800 $\mu m^2$ to 22,800 $\mu m^2$, from 2800 $\mu m^2$ to 45,500 $\mu m^2$, or from 5600 $\mu m^2$ to 11,400 $\mu m^2$. Other examples are possible.

The spherical ball 2121 has a radius and the seat opening 2131 has a radius. In various implementations, the radius of the spherical ball 2121 can be greater than the radius of the seat opening 2131, e.g., such that the spherical ball 2121 can substantially cover the seat opening 2131 in the closed position while also providing the gap therebetween (e.g., due to the absence of a seal provided by an O-ring). The material properties (e.g., hardness) of the spherical ball 2121 and/or seat opening 2131 (e.g., the interior surfaces of the check valve 2108) can be chosen so as to maintain the gap therebetween. In some designs, the radius of the spherical ball 2121 can be greater than the radius of the seat opening 2131 by at least 25%, by at least 30%, by at least 35%, or by at least 40%. In some designs, the radius of the spherical ball 2121 can be greater than the radius of the seat opening 2131 by no more than 30%, by no more than 35%, by no more than 40%, or by no more than 45%. In some designs, the radius of the spherical ball 2121 can be greater than the radius of the seat opening 2131 by an amount within a range formed by any of these values, e.g., from 25% to 30%, from 25% to 35%, from 25% to 40%, or from 25% to 45%. Other examples are possible.

In some examples, the check valve may only have one pair of a spherical ball 2121 and a seat opening 2131. In some implementations, the check valve 2108 can have additional pairs of a spherical ball and a seat opening configured to operate in the same or a similar manner as spherical ball 2121 and seat opening 2131. In FIG. 14, there are two pairs of a spherical ball and a seat opening. For example, in FIG. 14, the check valve 2108 is shown to include a second spherical ball 2122 and a second seat opening 2132 that operate in the same or a similar manner as spherical ball 2121 and seat opening 2131 (e.g., with a gap therebetween to provide an escape path for gas).

In one aspect, the check valve 2108 permits at least 5%, at least 10%, at least 20%, at least 30%, at least 40% of the pressure between the spherical ball 2121 and the spherical ball 2122 (and desirably between the first pump chamber 2018 and the spherical ball 2122) to be released in 8 hours, 10 hours or 12 hours when the system has an internal pressure of 100 psi, 120 psi or 140 psi and the ambient pressure is 100 kilopascals. In one aspect, the check valve 2108 permits no more than 5%, no more than 10%, no more than 20%, no more than 30%, no more than 40% of the pressure between the spherical ball 2121 and the spherical ball 2122 (and desirably between the first pump chamber 2018 and the spherical ball 2122) to be released in 8 hours, 10 hours or 12 hours when the system has an internal pressure of 100 psi, 120 psi or 140 psi and the ambient pressure is 100 kilopascals. In one aspect, the check valve 2108 permits between 5% and 30%, between 10% and 50%, between 5% and 40%, between 5% and 50% of the pressure between the spherical ball 2121 and the spherical ball 2122 (and desirably between the first pump chamber 2018 and the spherical ball 2122) to be released in 8 hours, 10 hours or 12 hours when the system has an internal pressure of 100 psi, 120 psi or 140 psi. and the ambient pressure is 100 kilopascals. In one aspect, the check valve 2108 permits the pressure between the spherical ball 2121 and the spherical ball 2122 and the outlet connector passage 2042 (and desirably between the first pump chamber 2018 and the spherical ball 2122 and the outlet connector passage 2042) to equalize within 8 hours, 10 hours or 12 hours when the system has an internal pressure of 100 psi, 120 psi or 140 psi and the ambient pressure is 100 kilopascals. The above ranges in this paragraph desirably apply when the fluid being pumped by the diaphragm pump has a dynamic viscosity of 0.00089 pascal-seconds.

In some examples, there may be more than two pairs (e.g., three, four, five, etc.) of a spherical ball and a seat opening. In some examples, at least one of the additional pairs of a spherical ball and seat opening may operate in the same or a similar manner as spherical ball 1121 and seat opening 1131 in FIG. 12 (e.g., with no gap therebetween).

As described herein, the check valve 2108 may be without one or more O-rings (e.g., without one or more of the O-rings 1141, 1142 in the check valve 1108 shown of FIGS. 11 and 12). Although one or more O-rings are not present, in various instances, the check valve 2108 shown in FIGS. 13 and 14 can still be configured to permit fluid flow from the first pump chamber 2018 to the assembly outlet 2014 or outlet connector passage 2042 when a cracking pressure is exceeded. The second check valve 2108 can also still reduce (e.g., and inhibit or prevent in various instances) fluid flow into the first pump chamber 2018 from the assembly outlet 2014 or outlet connector passage 2042. As a result, the diaphragm pump with a degassing valve 2108 (e.g., at least one degassing valve 2108) can aid in pumping and priming against a high line of pressure, such as greater than 100 psi (e.g., 120 psi, 125 psi, 130 psi, 135 psi, 140 psi, 145 psi, 150 psi, 155 psi, 160 psi, 165 psi, etc.) or within a range of formed by any of these values, e.g., greater than 100 psi to 165 psi, from 120 psi to 165 psi, or from 125 psi to 165 psi. Other examples are possible.

As described herein, various combinations of designs are possible. For example, the number of check valves that are unsealed (e.g., having a gap between the spherical ball and seating opening) to provide an escape path for gas in the closed position is not limited. For example, the pump assembly may have at least one check valve that is unsealed when in the closed position and at least one check valve that is sealed when in the closed position. In another example, the pump assembly may have at least one check valve that is unsealed when in the closed position and at least three check valves that are sealed when in the closed position. FIG. 13 shows an example pump assembly 2010 having one check valve 2108 that is unsealed when in the closed position (e.g., check valve 2010 shown as having a gap between each pair of a spherical ball and a seat opening) and three check valves 2104, 2106, 2110 that are sealed when in the closed position (e.g., each check valve shown as having no gap between each pair of a spherical ball and a seat opening). In another example, the pump assembly may have at least two check valves that are unsealed when in the closed position and at least two check valves that are sealed when in the closed position. For example, with reference to FIG. 13, the two outlet check valves 2108 and 2110 may be unsealed in the closed position (e.g., each check valve having a gap between each pair of a spherical ball and a seat opening) and the two inlet check valves 2104, 2106 may be sealed in the closed position (e.g., each check valve having no gap between each pair of a spherical ball and a seat opening). Various designs are possible.

In some instances, an unsealed check valve 2108 can cause some flow rate loss. To reclaim the flow loss, the pump stroke length can be modified. For example, with reference to FIG. 13, the rest position of the first diaphragm 2100 and/or the second diaphragm 2102 can be further within the first pump chamber 2018 and/or the second pump chamber

2020 respectively to provide a fluid flow rate as if the second check valve 2108 were scaled in the closed position (e.g., as the second check valve 1108 of FIG. 11). Although the fourth check valve 2110 in FIG. 13 is shown as being not unsealed in the closed position, if the fourth check valve 2110 were unsealed in the closed position (e.g., like the second check valve 2108), the position of the first diaphragm 2100 and/or the second diaphragm 2102 can be further within the first pump chamber 2018 and/or the second pump chamber 2020 respectively to provide a fluid flow rate as if the second check valve 2108 and the fourth check valve 2110 were sealed in the closed position. In other words, one or more of the diaphragms can be positioned within the respective pump chamber to accommodate for the fluid flow rate loss by having one or more unsealed check valves. In some examples, as shown in FIG. 13, one or more spacers 2171, 2172 can be added to help maintain the positioning of one or more of the pistons 2056, 2058 and/or one or more of the diaphragms 2100, 2102.

In various designs, the maximum distance the first diaphragm 2100 extends into the first pump chamber 2018 and/or the maximum distance the second diaphragm 2102 extends into the second pump chamber 2020 can provide a fluid flow rate within 5%, 10%, 15%, 20%, 25%, or 30% (or a percentage within a range formed by any of these values) of the fluid flow rate which there would be through the second check valve 2108 and/or the fourth check valve 2110 if the second check valve 2018 and/or the fourth check valve 2110 were sealed when in the closed position.

Although examples of the diaphragm pump are explained with a multiple diaphragm pump (e.g., with two pump chambers 1018, 1020), a single diaphragm pump with a degassing valve is also possible. In some such examples, a first check valve (e.g., positioned between the assembly inlet and the pump chamber) can be sealed in the closed position and a second check valve (e.g., positioned between the pump chamber and the assembly outlet) can be unsealed in the closed position. The first check valve can be sealed with one or more O-rings.

For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

Although embodiments of these inventions have been disclosed in the context of certain examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions.

What is claimed is:

1. A diaphragm pump assembly comprising:

an assembly inlet;

an assembly outlet;

a first pump chamber positioned in a first fluid path between the assembly inlet and outlet;

a second pump chamber positioned in a second fluid path between the assembly inlet and outlet;

a first diaphragm positioned at least partially within the first pump chamber at a rest position, the first diaphragm having a perimeter sealingly connected to one or more walls of the first pump chamber;

a second diaphragm positioned at least partially within the second pump chamber at a rest position, the second diaphragm having a perimeter sealingly connected to one or more walls of the second pump chamber;

a first piston connected to the first diaphragm, the first piston movable linearly;

a second piston connected to the second diaphragm, the second piston movable linearly;

wherein:

movement of the first piston toward the first pump chamber forces a portion of the first diaphragm to move from its rest position to a position further within the first pump chamber and to increase pressure in the first pump chamber;

movement of the first piston toward the first pump chamber forces a portion of the second diaphragm to move from its rest position to a position away from the second pump chamber and to reduce pressure in the second pump chamber;

movement of the second piston toward the second pump chamber forces a portion of the first diaphragm to move from its rest position to a position away from the first pump chamber and to reduce pressure in the first pump chamber;

movement of the second piston toward the second pump chamber forces a portion of the second diaphragm to move from its rest position to a position further within the second pump chamber and to increase pressure in the second pump chamber;

a first check valve positioned in a fluid path between the assembly inlet and the first pump chamber, the first check valve configured when in an opened position to permit fluid flow from the assembly inlet into the first pump chamber and when in a closed position to inhibit fluid flow from the first pump chamber toward the assembly inlet;

a second check valve positioned in a fluid path between the first pump chamber and the assembly outlet, the second check valve configured when in an opened position to permit fluid flow from the first pump chamber toward the assembly outlet and when in a closed position to reduce fluid flow from the assembly outlet into the first pump chamber;

a third check valve positioned in a fluid path between the assembly inlet and the second pump chamber, the third check valve configured when in an opened position to permit fluid flow from the assembly inlet into the second pump chamber and when in a closed position to inhibit fluid flow from the second pump chamber toward the assembly inlet; and a fourth check valve positioned in a fluid path between the second pump chamber and the assembly outlet, the fourth check valve configured when in an opened position to permit fluid flow from the second pump chamber toward the assembly outlet and when in a closed position to reduce fluid flow from the assembly outlet into the second pump chamber, wherein each check valve comprises at least one pair of a spherical ball and a seat opening, wherein for each pair, the spherical ball contacts the seat opening when in the closed position;

wherein in the closed position, the second check valve has for each pair, a gap between its spherical ball and seat opening to provide an escape path for gas;

wherein in the closed position, the first and third check valves have for each pair, no gap between its spherical ball and seat opening; and wherein the rest position of the first diaphragm is further within the first pump chamber and/or the rest position of the second diaphragm is further within the second pump chamber to provide a fluid flow rate as if the second check valve has for each pair, no gap between its spherical ball and seat opening when in the closed position and/or the fourth check valve has for each pair, no gap between its spherical ball and seat opening when in the closed position.

2. The assembly of claim 1, wherein for each pair, the gap of the second check valve is at least 2800 $\mu m^2$.

3. The assembly of claim 1, wherein for each pair, the gap of the second check valve is no larger than 45,500 $\mu m^2$.

4. The assembly of claim 1, wherein for each pair, the gap of the second check valve is in the range from 2800 $\mu m^2$ to 45,500 $\mu m^2$.

5. The assembly of claim 1, wherein for each check valve, for each pair, the spherical ball has a radius and the seat opening has a radius, wherein the radius of the spherical ball is greater than the radius of the seat opening.

6. The assembly of claim 5, wherein the radius of the spherical ball is greater than the radius of the seat opening by at least 25%.

7. The assembly of claim 5, wherein the radius of the spherical ball is greater than the radius of the seat opening by no more than 45%.

8. The assembly of claim 5, wherein the radius of the spherical ball is greater than the radius of the seat opening by an amount within the range from 25% to 45%.

9. The assembly of claim 1, wherein in the closed position, the fourth check valve has for each pair, no gap between its spherical ball and seat opening.

10. The assembly of claim 9, wherein for each pair in the fourth check valve, the seat opening is provided by at least one O-ring.

11. The assembly of claim 1, wherein in the closed position, the fourth check valve has for each pair, a gap between its spherical ball and seat opening to provide an escape path for gas.

12. The assembly of claim 11, wherein for each pair, the gap of the fourth check valve is at least 2800 $\mu m^2$.

13. The assembly of claim 11, wherein for each pair, the gap of the fourth check valve is no larger than 45,500 $\mu m^2$.

14. The assembly of claim 11, wherein for each pair, the gap of the fourth check valve is in the range from 2800 $\mu m^2$ to 45,500 $\mu m^2$.

15. The assembly of claim 1, wherein for each pair in the first and third check valves, the seat opening is provided by at least one O-ring.

16. The assembly of claim 1, wherein the at least one pair comprises one pair.

17. The assembly of claim 1, wherein the at least one pair comprises two pairs.

18. The assembly of claim 1, wherein the assembly is capable of being primed at a pressure greater than 100 psi.

19. The assembly of claim 18, wherein the assembly is capable of being primed at a pressure within a range of between 100 psi to 165 psi.

20. The assembly of claim 19, wherein the assembly is capable of being primed at a pressure within a range of between 120 psi to 165 psi.

21. The assembly of claim 1, wherein the assembly is configured to pump a chemical that off-gasses and the second check valve provides the escape path for the off-gas.

22. The assembly of claim 21, wherein the chemical is sodium hypochlorite.

23. The assembly of claim 1, further comprising:

a motor;

a motor drive shaft connected to the motor;

an offset cam connected to the motor drive shaft and configured to rotate in unison with the motor drive shaft;

wherein the offset cam is configured to push the first piston in a first direction toward the first pump chamber during a first portion of one rotation of the motor drive shaft and to push the second piston in a second direction toward the second pump chamber during a second portion of one rotation of the motor drive shaft, wherein the first direction and the second direction are collinear.

24. A diaphragm pump assembly comprising:

an assembly inlet;

an assembly outlet;

a pump chamber positioned in a fluid path between the assembly inlet and outlet;

a diaphragm positioned at least partially within the pump chamber at a rest position, the diaphragm sealingly connected to one or more walls of the pump chamber;

a movable piston connected to the diaphragm;

wherein:

movement of the piston toward the pump chamber forces a portion of the diaphragm to move from its rest position to a position further within the pump chamber and to increase pressure in the pump chamber;

movement of the piston away from the pump chamber forces a portion of the diaphragm to move from its rest position to a position away from the pump chamber and to reduce pressure in the pump chamber;

a first check valve positioned in a fluid path between the assembly inlet and the pump chamber, the first check valve configured when in an opened position to permit fluid flow from the assembly inlet into the pump chamber and when in a closed position to inhibit fluid flow from the pump chamber toward the assembly inlet;

a second check valve positioned in a fluid path between the pump chamber and the assembly outlet, the second check valve configured when in an opened position to permit fluid flow from the pump chamber toward the assembly outlet and when in a closed position to reduce fluid flow from the assembly outlet into the pump chamber;

wherein in the closed position, the second check valve is unsealed to provide an escape path for gas;

wherein in the closed position, the first check valve is sealed; and wherein the maximum distance the diaphragm extends into the pump chamber provides a fluid flow rate within twenty percent of a fluid flow rate which there would be through the second check valve if the second check valve were sealed when in the closed position.

25. The assembly of claim 24, wherein in the closed position, the first check valve is sealed with at least one O-ring.

26. The assembly of claim 24, wherein in the closed position, the first check valve is sealed with two O-rings.

27. The assembly of claim 24, wherein each check valve comprises a spherical ball and a seat opening, wherein the spherical ball contacts the seat opening when in the closed position, wherein in the closed position, the first check valve has no gap between its spherical ball and seat opening, and wherein in the closed position, the second check valve has a gap between its spherical ball and seat opening.

28. The assembly of claim 27, wherein each check valve comprises a second spherical ball and a second seat opening, wherein the second spherical ball contacts the second seat opening when in the closed position, wherein in the closed position, the first check valve has no gap between its second spherical ball and second seat opening, and wherein in the closed position, the second check valve has a gap between its second spherical ball and second seat opening.

29. The assembly of claim 24, wherein the assembly is capable of being primed at a pressure of greater than 100 psi.

30. The assembly of claim 29, wherein the assembly is capable of being primed at a pressure within a range of between 120 psi to 165 psi.

31. The assembly of claim 24, wherein the assembly is configured to pump a chemical that off-gasses and the second check valve provides the escape path for the off-gas.

32. The assembly of claim 31, wherein the chemical is sodium hypochlorite.

33. The assembly of claim 24, further comprising:

a motor;

a motor drive shaft connected to the motor;

a cam connected to the motor drive shaft and configured to rotate in unison with the motor drive shaft;

wherein the cam is configured to push the piston in a first direction toward the pump chamber during a first portion of one rotation of the motor drive shaft and to push the piston in a second direction away from the pump chamber during a second portion of one rotation of the motor drive shaft, wherein the first direction and the second direction are collinear.

34. The assembly of claim 24, wherein the second check valve permits at least 30% of the pressure between the first pump chamber and the assembly outlet to be released in 8 hours.

35. The assembly of claim 24, wherein the second check valve permits the pressure between a first spherical ball and a second spherical ball and the assembly outlet to equalize within 10 hours when the system has an internal pressure of 120 psi and the outlet has a pressure of 50 psi.

* * * * *